US006565092B1

(12) United States Patent
McCarthy, Jr.

(10) Patent No.: US 6,565,092 B1
(45) Date of Patent: May 20, 2003

(54) HOCKEY CARD GAME

(76) Inventor: John Paul McCarthy, Jr., 101 2nd St. South, Apt. 1004, Fargo, ND (US) 58103

( * ) Notice: Subject to any disclaimer, the term of this patent is extended or adjusted under 35 U.S.C. 154(b) by 0 days.

(21) Appl. No.: 10/056,310

(22) Filed: Jan. 23, 2002

(51) Int. Cl.[7] ..... A63F 1/00

(52) U.S. Cl. ..... 273/292; 273/236; 273/308; 273/303; 273/274; 273/298

(58) Field of Search ..... 273/292, 274, 273/236, 303, 308, 298

(56) References Cited

U.S. PATENT DOCUMENTS 5,186,467 A * 2/1993 Chasin ..... 273/298
5,221,091 A * 6/1993 Gallegos et al. ..... 273/247
5,505,457 A * 4/1996 Boylan et al. ..... 273/274
6,012,721 A * 1/2000 Harnish ..... 273/298
6,068,259 A * 5/2000 Dolin ..... 273/244
6,227,544 B1 * 5/2001 White et al. ..... 273/296
6,293,868 B1 * 9/2001 Bernard ..... 463/42

* cited by examiner

*Primary Examiner*—Benjamin H. Layno
*Assistant Examiner*—D Collins

(57) ABSTRACT

A hockey card game is described which can be played with a combined three fifty-two card playing deck to simulate real ice hockey matches. The hockey card game incorporates a wide variety of various circumstances such as, major and minor penalties, penalty shots, goal shots, puck passes, one man power plays, two man power plays, offensive and defensive open net, and breakaway situations. The hockey card game also incorporates various performance factors which can be used to mimic a real ice hockey team by weighting the fictitious teams in the hockey card game with the real statistics from the real ice hockey teams from the previous season. In this way, after the various statistical weights are established, then the hockey card game can be played to simulate matches between any real ice hockey teams by combining three standard fifty two card decks together to form a play deck and a miscellaneous deck.

6 Claims, 2 Drawing Sheets

HOCKEY CARD GAME

FIELD OF THE INVENTION

The present invention relates to card games, more particularly to a hockey card game for use in simulating real ice hockey matches.

DESCRIPTION OF THE PRIOR ART

Ice hockey matches have fascinated fans for well over one hundred years, yet no unique card games are known by the present inventor which incorporate the wide variety of situations which are likely to arise in a typical ice hockey match. Some of these ice hockey dynamic situations would be but not limited to circumstances such as, major and minor penalties, penalty shots, goal shots, puck passes, one man power plays, two man power plays, offensive and defensive open net, and breakaway situations. Therefore, there is a need for fans of ice hockey who crave the excitement associated with the omnipresent changing circumstances in ice hockey to have a card game which mimic these circumstances. Furthermore, there is a need for a card game that can teach fans the various factors that may influence how an ice hockey match won or lost. Yet furthermore, there is a need for a card game that can be used to teach the applied mathematics while simultaneously enjoying the excitement associated with experiencing an ice hockey match.

The apparatus and method of playing a baseball board game disclosed by Poisson in U.S. Pat. No. 5,762,337 discloses a baseball card game that can only be played with on non-standard card and doesn't in anyway match the playing circumstances found in ice hockey.

The mathematical board game apparatus disclosed by Stein and Stein in U.S. Pat. No. 3,869,124 discloses a mathematical game for play by two or more persons comprising a playing board divided into a series of squares, arranged in rows and columns, each square bearing a number indicia and a set of playing pieces for each player. The Stein et al. disclosure requires the playing board and cannot be played with standard playing cards as well as the Stein et al. disclosure lacks any significant similarity to the playing situations commonly found in ice-hockey.

The baseball card game disclosed by Carter in U.S. Pat. No. 4,822,043 discloses a baseball game suitable for table play including a random character generator, at least one part card containing a series of characters generatable by the random character generator and corresponding play events, a series of play action cards having on a first side a listing of player positions, numerical field ratings for the positions, and a play event for each of the fielding rating for each player position.

The Carter disclosure requires non-standard playing cards to play. Furthermore, the Carter disclosure lacks any significant similarity in the play that might be encountered in situations commonly found in ice hockey matches.

The baseball game disclosed by Parker and Gregory in U.S. Pat. No. 2,049,314 discloses a baseball game that is played by a number of players in which a deck of specially constructed and marked cards is used in combination with an indicating means which may take the form of a chart, and score cards. The Parker and Gregory disclosure explicitly requires non-standard playing cards to play. Furthermore, the Parker and Gregory baseball card game lacks any significant similarity in the play circumstances that might be encountered in situations commonly found in ice hockey matches.

The playing cards disclosed by Beam in U.S. Pat. No. 1,177,677 discloses non-standard playing cards that can be used to play a baseball like game. The Beam disclosure explicitly requires non-standard playing cards to play. Furthermore, the Beam baseball cards lacks any significant similarity in the play circumstances that might be encountered in situations commonly found in ice hockey matches.

While all of the above-described devices fulfill their respective, particular objectives and requirements, the aforementioned patents do not describe a hockey card game that would specifically match the user's particular individual needs. The above-described patents make no provision for a card game that would mimic an ice hockey match such as providing playing situations that mimic major and minor penalties, penalty shots, goal shots, puck passes, one man power plays, two man power plays, offensive and defensive open net, and breakaway situations.

Therefore, a need exist for a new and improved hockey card game that can be used for there is a need for an hockey card game that can provide a fan the excitement associated with the omnipresent changing circumstances in ice hockey to have a card game which mimic these circumstances. Furthermore, there is a need for a card game that can teach fans the various factors which may influence how an ice hockey match won or lost. Yet furthermore, there is a need for a card game that can be used to teach the applied mathematics while simultaneously enjoying the excitement associated with experiencing an ice hockey match. In this respect, the hockey card game according to the present invention substantially departs from the conventional concepts and designs of the prior art, and in doing so provides a method primarily developed for the purpose of simulating ice hockey matches by using three standard fifty two card playing decks.

SUMMARY OF THE INVENTION

A hockey card game is described which can be played with a combined three fifty two card playing deck to simulate real ice hockey matches. The hockey card game incorporates a wide variety of various circumstances such as, major and minor penalties, penalty shots, goal shots, puck passes, one man power plays, two man power plays, offensive and defensive open net, and breakaway situations. The hockey card game also incorporates various performance factors which can be used to mimic a real ice hockey team by weighting the fictitious teams in the hockey card game with the real statistics from the real ice hockey teams from the previous season. In this way, after the various statistical weights are established, then the hockey card game can be played to simulate matches between any real ice hockey teams by combining three standard fifty two card decks together to form a play deck and a miscellaneous deck.

In view of the foregoing disadvantages inherent in the known type card games now present in the prior art, the present invention provides an improved hockey card game, which will be described subsequently in great detail, is to provide a new and improved hockey card game which is not anticipated, rendered obvious, suggested, or even implied by the prior art, either alone or in any combination thereof.

To attain this, the present invention essentially comprises a hockey card game which incorporates a wide variety of various circumstances such as, major and minor penalties, penalty shots, goal shots, puck passes, one man power plays, two man power plays, offensive and defensive open net, and breakaway situations. The hockey card game also incorporates various performance factors which can be used to mimic a real ice hockey team by weighting the fictitious teams in the hockey card game with the real statistics from the real ice hockey teams from the previous season. In this way, after the various statistical weights are established, then the hockey card game can be played to simulate matches between any real ice hockey teams by combining three standard fifty two card decks together to form a play deck and a miscellaneous deck.

There has thus been outlined, rather broadly, the more important features of the invention in order that the detailed description thereof that follows may be better understood, and in order that the present contribution of the art may be better appreciated.

The invention may also includes modification of the various factors associated with play in ice hockey such as control factors, shot factors and goal factors as discussed below.

There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hockey card game that has all the advantages of the prior art and non of the disadvantages by providing fans of ice hockey the excitement associated with the omnipresent changing circumstances in ice hockey to have a card game which mimic these circumstances.

Yet another object is to teach fans the subtitles associated with the various factors which may influence how an ice hockey match won or lost. These factors include simulated situations such as major and minor penalties, penalty shots, goal shots, puck passes, one man power plays, two man power plays, offensive and defensive open net, and breakaway situations.

Even yet furthermore, there is a need for a card game that can be used to teach the applied mathematics while simultaneously enjoying the excitement associated with experiencing an ice hockey match.

It is another object of the present invention to provide a new and improved hockey card game that may be easily and efficiently manufactured and marketed.

An even further object of the present invention is to provide a new and improved hockey card game that has a low cost of manufacture with regard to both materials and labor, and which accordingly is then susceptible of low prices of sale to the consuming public, thereby making such multipurpose storage unit and system economically available to the buying public.

Still another object of the present invention is to provide a new hockey card game that provides in the apparatuses and methods of the prior art some of the advantages thereof, while simultaneously overcoming some of the disadvantages normally associated therewith.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
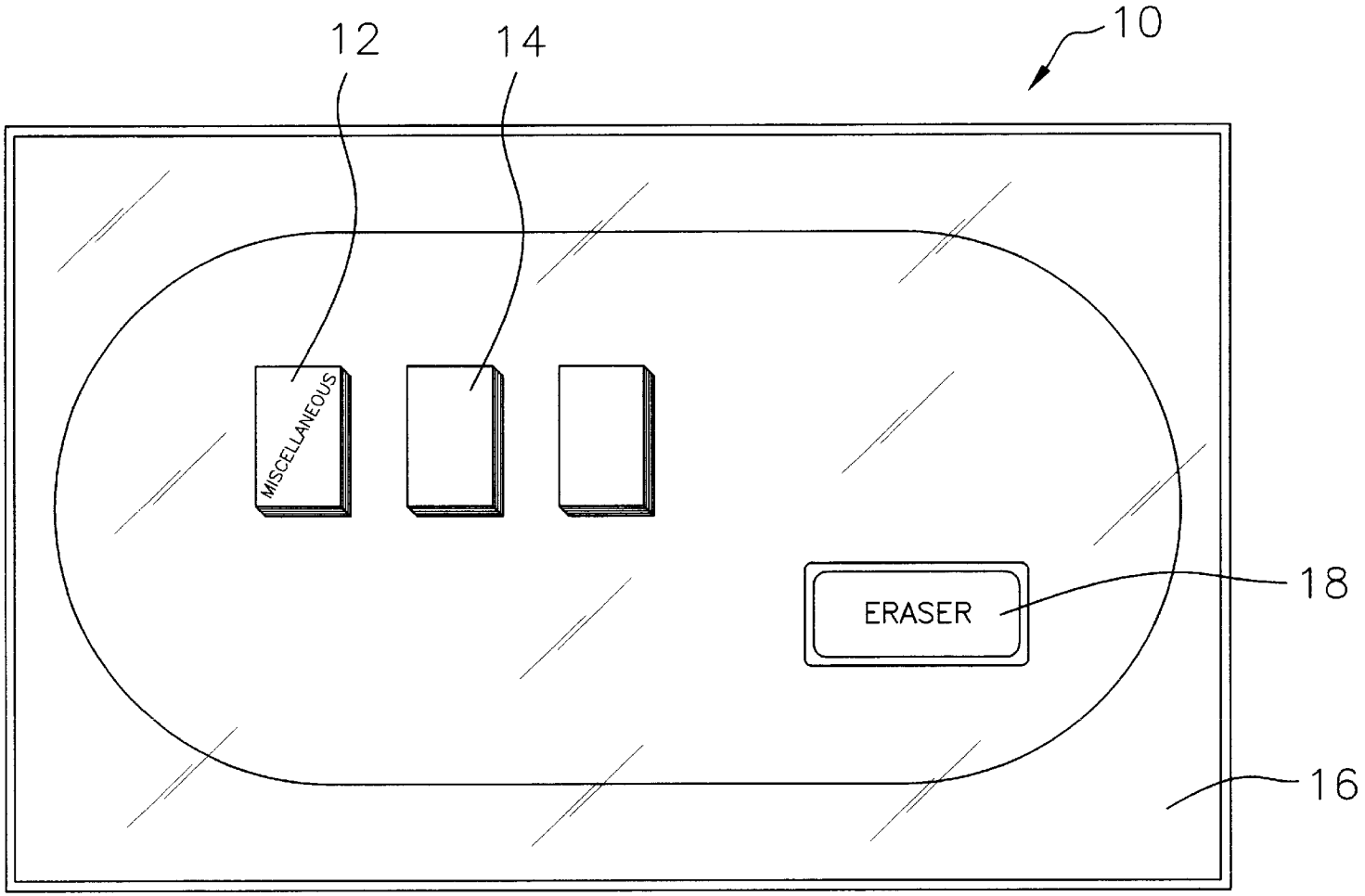
FIG. 1 is a perspective view of a tabletop in which the preferred embodiment of the hockey card game may be played in accordance with the principles of the present invention.

The present invention of a hockey card game for teaching applied mathematics and for enjoying a simulated ice hockey match against two opposing teams played by at least one player, the hockey card game comprises setting up various statistical parameters associated with the hockey card game and then organizing the mechanics of how to play the hockey card game.

The first statistical parameter associated with the hockey card game that is set up is assigning each card in a standard fifty two card deck a unique point value, wherein the two of diamonds is assigned a point value of two points, the two of hearts is assigned a point value of two and one quarter points, the two of clubs is assigned a point value of two and one half points, the two of spades is assigned a point value of two and three fourths points, the three of diamonds is assigned a point value of three points, the three of hearts is assigned a point value of three and one quarter points, the three of clubs is assigned a point value of three and one half points, the three of spades is assigned a point value of three and three fourths points, the four of diamonds is assigned a point value of four points, the four of hearts is assigned a point value of four and one quarter points, the four of clubs is assigned a point value of four and one half points, the four of spades is assigned a point value of four and three fourths points, the five of diamonds is assigned a point value of five points, the five of hearts is assigned a point value of five and one quarter points, the five of clubs is assigned a point value of five and one half points, the five of spades is assigned a point value of five and three fourths points, the six of diamonds is assigned a point value of six points, the six of hearts is assigned a point value of six and one quarter points, the six of clubs is assigned a point value of six and one half points, the six of spades is assigned a point value of six and three fourths points, the seven of diamonds is assigned a point value of seven points, the seven of hearts is assigned a point value of seven and one quarter points, the seven of clubs is assigned a point value of seven and one half points, the seven of spades is assigned a point value of seven and three fourths points, the eight of diamonds is assigned a point value of eight points, the eight of hearts is assigned a point value of eight and one quarter points, the eight of clubs is assigned a point value of eight and one half points, the eight of spades is assigned a point value of eight and three fourths points, the nine of diamonds is assigned a point value of nine points, the nine of hearts is assigned a point value of nine and one quarter points, the nine of clubs is assigned a point value of nine and one half points, the nine of spades is assigned a point value of nine and three fourths points, the ten of diamonds is assigned a point value of ten points, the ten of hearts is assigned a point value of ten and one quarter points, the ten of clubs is assigned a point value of ten and one half points, the ten of spades is assigned a point value of ten and three fourths points, the jack of diamonds is assigned a point value of eleven points, the jack of hearts is assigned a point value of eleven and one quarter points, the jack of clubs is assigned a point value of eleven and one half points, the jack of spades is assigned a point value of eleven and three fourths points, the queen of diamonds is assigned a point value of twelve points, the queen of hearts is assigned a point value of twelve and one quarter points, the queen of clubs is assigned a point value of twelve and one half points, the queen of spades is assigned a point value of twelve and three fourths points, the king of diamonds is assigned a point value of thirteen points, the king of hearts is assigned a point value of thirteen and one quarter points, the king of clubs is assigned a point value of thirteen and one half points, the king of spades is assigned a point value of thirteen and three fourths points, the ace of diamonds is assigned a point value of fifteen points, the ace of hearts is assigned a point value of fifteen points and one quarter points, the ace of clubs is assigned a point value of fifteen points and one half points, and the ace of spades is assigned a point value of fifteen points and no three fourths points.

The second statistical parameter associated with the hockey card game that is set up is designating each card in the standard fifty two card deck a unique probability threshold value, wherein the two of diamonds is designated a probability threshold value of one fifty second, the two of hearts is designated a probability threshold value of two fifty seconds, the two of clubs is designated a probability threshold value of three fifty seconds, the two of spades is designated a probability threshold value of four fifty seconds, the three of diamonds is designated a probability threshold value of five fifty seconds, the three of hearts is designated a probability threshold value of six fifty seconds, the three of clubs is designated a probability threshold value of seven fifty seconds, the three of spades is designated a probability threshold value of eight fifty seconds, the four of diamonds is designated a probability threshold value of nine fifty seconds, the four of hearts is designated a probability threshold value of ten fifty seconds, the four of clubs is designated a probability threshold value of eleven fifty seconds, the four of spades is designated a probability threshold value of twelve fifty seconds, the five of diamonds is designated a probability threshold value of thirteen fifty seconds, the five of hearts is designated a probability threshold value of fourteen fifty seconds, the five of clubs is designated a probability threshold value of fifteen fifty seconds, the five of spades is designated a probability threshold value of sixteen fifty seconds, the six of diamonds is designated a probability threshold value of seventeen fifty seconds, the six of hearts is designated a probability threshold value of eighteen fifty seconds, the six of clubs is designated a probability threshold value of nineteen fifty seconds, the six of spades is designated a probability threshold value of twenty fifty seconds, the seven of diamonds is designated a probability threshold value of twenty one fifty seconds, the seven of hearts is designated a probability threshold value of twenty two fifty seconds, the seven of clubs is designated a probability threshold value of twenty three fifty seconds, the seven of spades is designated a probability threshold value of twenty four fifty seconds, the eight of diamonds is designated a probability threshold value of twenty five fifty seconds, the eight of hearts is designated a probability threshold value of twenty six fifty seconds, the eight of clubs is designated a probability threshold value of twenty seven fifty seconds, the eight of spades is designated a probability threshold value of twenty eight fifty seconds, the nine of diamonds is designated a probability threshold value of twenty nine fifty seconds, the eight of hearts is designated a probability threshold value of thirty fifty seconds, the nine of clubs is designated a probability threshold value of thirty one fifty seconds, the nine of spades is designated a probability threshold value of thirty two fifty seconds, the ten of diamonds is designated a probability threshold value of thirty three fifty seconds, the ten of hearts is designated a probability threshold value of thirty four fifty seconds, the ten of clubs is designated a probability threshold value of thirty five fifty seconds, the ten of spades is designated a probability threshold value of thirty six fifty seconds, the jack of diamonds is designated a probability threshold value of thirty seven fifty seconds, the jack of hearts is designated a probability threshold value of thirty eight fifty seconds, the jack of clubs is designated a probability threshold value of thirty nine fifty seconds, the jack of spades is designated a probability threshold value of forty fifty seconds, the queen of diamonds is designated a probability threshold value of forty one fifty seconds, the queen of hearts is designated a probability threshold value of forty two fifty seconds, the queen of clubs is designated a probability threshold value of forty three fifty seconds, the queen of spades is designated a probability threshold value of forty four fifty seconds, the king of diamonds is designated a probability threshold value of forty five fifty seconds, the king of hearts is designated a probability threshold value of forty six fifty seconds, the king of clubs is designated a probability threshold value of forty seven fifty seconds, the king of spades is designated a probability threshold value of forty eight fifty seconds, the ace of diamonds is designated a probability threshold value of forty nine fifty seconds, the ace of hearts is designated a probability threshold value of fifty seconds, the ace of clubs is designated a probability threshold value of fifty one fifty seconds, and the ace of spades is designated a probability threshold value of fifty two fifty seconds.

The third statistical parameter associated with the hockey card game that is set up is allotting each card in the standard fifty two playing card deck a unique hierarchy value, wherein the two of diamonds is allotted a card hierarchy value of one, the two of hearts is allotted a card hierarchy value of two, the two of clubs is allotted a card hierarchy value of three, the two of spades is allotted a card hierarchy value of four, the three of diamonds is allotted a card hierarchy value of five, the three of hearts is allotted a card hierarchy value of six, the three of clubs is allotted a card hierarchy value of seven, the three of spades is allotted a card hierarchy value of eight, the four of diamonds is allotted a card hierarchy value of nine, the four of hearts is allotted a card hierarchy value of ten, the four of clubs is allotted a card hierarchy value of eleven, the four of spades is allotted a card hierarchy value of twelve, the five of diamonds is allotted a card hierarchy value of thirteen, the five of hearts is allotted a card hierarchy value of fourteen, the five of clubs is allotted a card hierarchy value of fifteen, the five of spades is allotted a card hierarchy value of sixteen, the six of diamonds is allotted a card hierarchy value of seventeen, the six of hearts is allotted a card hierarchy value of eighteen, the six of clubs is allotted a card hierarchy value of nineteen, the six of spades is allotted a card hierarchy value of twenty, the seven of diamonds is allotted a card hierarchy value of twenty one, the seven of hearts is allotted a card hierarchy value of twenty two, the seven of clubs is allotted a card hierarchy value of twenty three, the seven of spades is allotted a card hierarchy value of twenty four, the eight of diamonds is allotted a card hierarchy value of twenty five, the eight of hearts is allotted a card hierarchy value of twenty six, the eight of clubs is allotted a card hierarchy value of twenty seven, the eight of spades is allotted a card hierarchy value of twenty eight, the nine of diamonds is allotted a card hierarchy value of twenty nine, the nine of hearts is allotted a card hierarchy value of thirty, the nine of clubs is allotted a card hierarchy value of thirty one, the nine of spades is allotted a card hierarchy value of thirty two, the ten of diamonds is allotted a card hierarchy value of thirty three, the ten of hearts is allotted a card hierarchy value of thirty four, the ten of clubs is allotted a card hierarchy value of thirty five, the ten of spades is allotted a card hierarchy value of thirty six, the jack of diamonds is allotted a card hierarchy value of thirty seven, the jack of hearts is allotted a card hierarchy value of thirty eight, the jack of clubs is allotted a card hierarchy value of thirty nine, the jack of spades is allotted a card hierarchy value of forty, the queen of diamonds is allotted a card hierarchy value of forty one, the queen of hearts is allotted a card hierarchy value of forty two, the queen of clubs is allotted a card hierarchy value of forty three, the queen of spades is allotted a card hierarchy value of forty four, the king of diamonds is allotted a card hierarchy value of forty five, the king of hearts is allotted a card hierarchy value of forty six, the king of clubs is allotted a card hierarchy value of forty seven, the king of spades is allotted a card hierarchy value of forty eight, the ace of diamonds is allotted a card hierarchy value of forty nine, the ace of hearts is allotted a card hierarchy value of fifty, the ace of clubs is allotted a card hierarchy value of fifty one, and the ace of spades is allotted a card hierarchy value of fifty two.

To simulate real life ice hockey teams various weighting factors are incorporated in the present invention of the hockey card game to simulate the unique characteristics and performances of real ice hockey teams. The first weighting factor used is the win-tie index is calculated for each particular team, wherein the win-tie index for each particular team is calculated by adding the total number of ties the corresponding ice hockey team achieved in the previous season to two times the total number of wins the corresponding ice hockey team achieved in the previous season. One of the opposing teams is designated as a home team and the other opposing team as a visitor team. A power index is calculated for each particular team, wherein the power index for each particular team is the win-tie index for each particular team plus ten points if the particular team is designated as the home team and minus ten points if the particular team is designated as the visitor team. A relative power factor is calculated by taking the absolute value of the difference in the power indexes of each team and dividing this absolute value by twenty five, and then rounding the quotient to the nearest one-quarter point. A goalie strength index for each particular team is calculated by dividing the total number of saves achieved by the corresponding ice hockey team in the previous season by the total number of shots attempted against the goal of the corresponding ice hockey team in the previous season. A goalie susceptibility index for each particular team is calculated by subtracting the corresponding goalie strength index of each particular team from one. A goalie card for each particular team is assigned to the playing card having a probability threshold value closest to the goalie susceptibility index for the respective team. A defensive threshold value for each particular team to be the point value is then associated with the goalie card for the respective team. An offensive strength index for each particular team is calculated by subtracting the average number of shots per game that the corresponding ice hockey team attempted in the previous season. The offensive weight factor is assigned a valued of at least fifty two. Preferably, the offensive weight factor is sixty two. An offensive strength threshold card for each particular team to be the card that is then associated with the card hierarchy value that most closely matches the offensive strength index for each particular team. Finally, an offensive strength threshold card value for each particular team is assigned to be the point value corresponding to the offensive strength threshold card for each particular team.

To simulate real ice hockey match such as control of the puck, shot frequencies and goal successes other statistical weighting factors are incorporated into the present invention of the hockey card game to match the various dynamic situations that may occur in a real ice hockey match. A power play control factor is assigned a value of at least three points. The preferred power play control factor is four points. A power play shot factor is assigned a value of at least one point. The preferred power play shot factor is two points. A power play goal factor is assigned a value of at least a one fourth point. The preferred power play goal factor is one half point. A short-handed shot factor is assigned a value of at least one point. The preferred short-handed shot factor is two. A short-handed goal factor is assigned a value of at least one fourth point. The preferred short-handed goal factor is three fourth points. A two-man power play control factor is assigned a value of at least four points. The preferred two-man power play control factor is five points. A two-man power play shot factor is assigned a value of at least one point. The preferred two-man power play shot factor is two points. A two-man power play goal factor is assigned a value of at least one fourth point. The preferred two-man power play goal factor is three fourth points. An open-net control factor is assigned a value of at least three points. The preferred open-net control factor is five points. An open-net shot factor is assigned a value of at least one point. The preferred open-net control factor is two points. An open-net goal factor is assigned a value of at least one fourth point. The preferred open-net goal factor is one half point. A defensive open-net shot factor is assigned a value of at least one point. The preferred defensive open-net shot factor is two points. A defensive-open net goal factor is assigned a value of at least four points. The preferred defensive open-net goal factor is seven points. A breakaway control factor is assigned a value of at least three points. The preferred breakaway control factor is five points. A breakaway shot factor is assigned a value of at least one point. The preferred breakaway shot factor is four points. A breakaway goal factor is assigned a value of at least one half point. The preferred breakaway goal factor is three points. An ace goal factor is assigned a value of at least one fourth point. The preferred ace goal factor is one fourth point.

Also a penalty foul situation is incorporated in the present invention of the hockey card game to mimic what a real ice hockey match penalty situation is by assigning a penalty card to be at least the two of diamonds. The preferred penalty card is the two of diamonds. During a penalty situation a penalty shot card is assigned to be at least the ace of diamonds.

The play duration of the present invention of the hockey card game is designed to match real ice hockey matches by assigning a time segment associated with each play to represent six seconds of play time in a real ice hockey match.

Starting the play of the present invention of the hockey card game is initiated by combining three standard fifty two playing card decks randomly together to form a combined deck. This is followed by assembling a play deck comprising one hundred and six playing cards from the combined deck. Finally, making a miscellaneous deck comprising fifty playing cards from the combined deck.

The present invention of the hockey card game may be played by two opposing players representing two respective opposing teams or the game may be played by a single player in a solitaire mode where the two opposing teams are played by the single player.

At the beginning of each round played by the present invention of the hockey card game, any player (i.e., team) may declare whether or not that the player will play a round in an open net offense mode of play. A round is the sequence of plays in a the game by ranging from control of the puck, shooting a puck, attempting a goal or scoring a goal.

The present invention of the hockey card game allows for the players to determine whether a team gains control of the puck by drawing one card each from the play deck for each of the two opposing teams. Exactly how control of the puck is achieved by drawing a card from the play deck will be discussed below.

In the event that a team draws the penalty card from the play deck, then that team is required to pull one card from the miscellaneous deck.

A major penalty in the present invention of the hockey card game occurs in the event when the pulled card from the miscellaneous deck is also the penalty card then a major penalty is received by the team that drew the penalty card from the play deck and pulled the penalty card from the miscellaneous deck. The major penalty enables the non-penalized team to use the power play mode of play for fifty turns in the hockey sports game when the penalized team is subjected to one penalty. The major penalty also enables the non-penalized team to use the two man power play mode of play for up to forty nine turns in the hockey card game when the penalized team is subjected to two or more penalties. The major penalty in the hockey card game simulates or represents an ice hockey player being placed on the bench for five minutes during an ice hockey match.

A minor penalty in the present invention of the hockey card game occurs in the event that a team draws the penalty card form the play deck and pulls a non penalty card from the miscellaneous deck. That is, a minor penalty is obtained by the team that drew the penalty card from the play deck and pulled the card from the miscellaneous deck which was not the penalty card. The minor penalty enables the non-penalized team to use the power play mode of play for up to twenty turns in the hockey sports game when the penalized team is subject to one penalty. The minor penalty also enables the non-penalized team to use the double man power play mode of play for up to nineteen turns in the hockey sports game when the penalized team is subjected to two or more penalties. The minor penalty is lifted against the penalized team in the event that the non-penalized team scores a goal within the twenty turns associated with the penalty to the penalized team obtaining the minor penalty. The minor penalty in the hockey card game represents the situation in the ice hockey match when the ice hockey player is taken out of the ice hockey match and placed on the bench for up to two minutes during the ice hockey match or until the non-penalized ice hockey team scores an goal.

A penalty shot situation in the present invention of the hockey card game is simulated when the team pulls a card from the miscellaneous deck that is the penalty shot card. That is, the team that drew penalty card from the play deck and pulled the penalty shot card from the miscellaneous deck is the team that gets the penalty shot possibility imposed against it is. If this occurs then the non-penalized team takes one card from the miscellaneous deck to determine if the non-penalized team is able to "control the puck" during this simulated penalty shot. The non-penalized team is able to "control the puck" if the point value of the card taken from the miscellaneous deck by the non-penalized team is greater than or equal to the point value of the penalty shot threshold criteria for the non-penalized team. The penalty shot threshold criteria for the non-penalized team is calculated by subtracting the breakaway shot factor from the offensive strength threshold value associated with the non-penalized team. If the non-penalized team is not able to successfully "control the puck" then there is no successful penalty shot and the game proceeds by drawing another pair of cards from the play deck. However, if the non-penalized team is able to successfully "control the puck" and thus "shot the puck", then the penalized team is given a turn to be able to "defend against the puck" by selecting a card from the miscellaneous deck. If the point value of the card selected from the miscellaneous deck by the penalized team is found to be greater than or equal to the goalie block shot threshold criteria associated with the penalized team then the penalized team "stopped the goal." On the other hand if the point value of the card selected from the miscellaneous deck by the penalized team is found to less than the goalie block shot threshold criteria associated with the penalized team then the non-penalized team "scored a goal." That is, the non-penalized team is able to successfully achieve "a goal" during a penalty shot situation, if the penalized team selects a card from the miscellaneous deck that has a point value less than the goalie block shot threshold criteria for the penalized team. Wherein the goalie block shot threshold criteria is calculated by adding the breakaway goal factor to the defensive threshold value associated with the penalized team.

The present invention of the hockey card game also simulates a "breakaway" scenario that might occur in an ice hockey match. A possible breakaway simulation occurs in the situation where one of the teams draws an ace from the play deck and the other team member draws a card that has a point value below the corresponding control threshold value. That is, a possible breakaway situation is mimicking the ice hockey card match when one player draws an ace and wins "control of the puck." The two players must then subsequently pick one card from the miscellaneous deck for each opposing team so that the sum of the point value of the corresponding drawn card to the point value of the corresponding picked card for each opposing team can be compared. If a difference of fourteen points or greater in the point value sums of the drawn card and the picked card is found between the opposing teams then team that drew the ace from the play deck is enabled in the breakaway mode of play. In the event that the point value of the corresponding chosen card for each opposing team is found to be less than fourteen, then the no team that accrued the ace "wins control of the puck" by being allowed to glean a "shot card" from the play deck so long as the other team doesn't draw a card that has a point value greater than of equal to the corresponding control threshold value. In the event that the both teams are found to have drawn cards that have point values greater than their respective control threshold values then each for the opposing teams then both teams accrue another card each from the play deck. Thereby, unenabling the breakaway mode of play if both teams are found to have drawn cards that have point values greater than their respective control threshold values.

Another possible breakaway situation in the present invention of the hockey card game may arise if any card accrued from the play deck is an ace in which each opposing team is then required to choose a card from the miscellaneous deck. Again, if the difference in the summed point value of the corresponding accrued card to the point value of the corresponding chosen card for each opposing team is found to be greater than or equal to fourteen, then the team that accrued the ace from the play deck is enabled to be in a breakaway mode of play. In the event that the difference in the summed point value of the corresponding accrued card and the chosen card for each opposing team is found to be less than fourteen, then the team that accrued the ace simply "wins control of the puck" by being allowed to glean a "shot card" from the play deck so long as the other team doesn't draw a card that has a point value greater than of equal to the corresponding control threshold value. In the event that the both teams are found to have accrued cards that have point values greater than their respective control threshold values then each for the opposing teams then both teams retrieve another card each from the play deck. Thereby, unenabling the breakaway mode of play if both teams are found to have accrued cards that have point values greater than their respective control threshold values.

Yet another possible breakaway situation that may arise in the present invention of the hockey card game is when any card retrieved from the play deck is found to be an ace. In which each opposing team is required to obtain a card from the miscellaneous deck from each opposing team. Again if the difference in the summed point value of the corresponding retrieved card to the point value of the corresponding obtained card for each opposing team is found to be greater than or equal to fourteen then the team that retrieved the ace from the play deck is enabled in a breakaway mode of play. In the event that the difference in the summed point value of the a corresponding retrieved card for and the obtained card for each opposing team is found to be less than fourteen, then the team that retrieved the ace "wins control of the puck" by being allowed to glean a "shot card" from the play deck so long as the other team doesn't retrieve card that has a point value greater than of equal to the corresponding control threshold value. In the event that the both teams are found to have retrieved cards that have point values greater than their respective control threshold values then each for the opposing teams then both teams draw another card each from the play deck. Thereby, unenabling the breakaway mode of play if both teams are found to have retrieved cards that have point values greater than their respective control threshold values.

In the present invention of the hockey card game the control factor sum for each opposing team is calculated by using a running sum of the following factors. The relative power factor is added to the control factor sum of the particular team if the particular team has been determined to be the team associated with having the larger of the two power indexes between the two opposing teams. The power play control factor is added to the control factor sum of the particular team if the team opposing the particular team is subject to only the minor penalty. The two-man power play control factor is added to the control factor sum of the particular team if the team opposing the particular team is subject to the major penalty. The open net control factor is added to the control factor sum of the particular team if the particular team declared prior to drawing the card from the play deck that it intended to play an open-net offense. Finally, the breakaway control factor is added to the control factor sum of the particular team if the particular team is enabled in the breakaway mode of play. Then the team that is associated with the larger of the two control factor sums is determined by finding the absolute value of the difference in the control factor sums between the two opposing teams. Subsequently, the control threshold value for each opposing team for the particular team that is determined to be the team associated with the larger of the two control factor sums set as the absolute value of the difference in the control factor sums between the two opposing teams. Whereas, the control threshold value for the particular team that was not determined to be the team associated with the larger of the two control factor sums is set as zero.

When the card drawn by the particular team in the present invention of the hockey card game is found to have a point value greater than the control threshold value associated with the particular team and when the opposing team is found to have drawn a card from the play deck that has a point value less than the control threshold value associated with the opposing team, then a card is gleaned from the play deck by a particular team. Thereby the gleaning a card from the play deck in the hockey card game represents or simulates winning the offensive control of the puck in the ice hockey match which eventually is followed by an attempted offensive shot at the goal. Another instance in the hockey card game that gleaning a card from the play deck may also be achieved by a particular team is when the card accrued by the particular team is found to have a point value greater than the control threshold value associated with the particular team and if the opposing team is found to have accrued a card from the play deck that has a point value less than the control threshold value associated with the opposing team. Yet again another instance in the hockey card game that gleaning a card from the play deck may also be achieved by a particular team is when the card retrieved by the particular team is found to have a point value greater than the control threshold value associated with the particular team and if the opposing team is found to have retrieved a card from the play deck that has a point value less than the control threshold value associated with the opposing team.

After gleaning the card from the play deck in the present invention of the hockey card game, a shot factor sum for the particular team is calculated by a running sum containing the following factors. The power play shot factor is added to the shot factor sum if the team opposing the particular team is subject to the minor penalty. The short handed shot factor is added to the shot factor sum if the particular team is the penalized team. The two-man power play control factor is added to the shot factor sum if the team opposing the particular team is subject to the major penalty. The open net shot factor is added to the shot factor sum if the team opposing the particular team declared prior to drawing the card from the play deck that it intended to play an open-net offense. The defensive open net shot factor is added to the shot factor sum if the team that did not glean the card from the play deck is also the team that declared that it would play a round in the open net offense mode of play. Finally, the breakaway shot factor is added to the shot factor sum if the particular team is enabled to be in the breakaway mode of play. Subsequently, the shot threshold value corresponding to the particular team that gleaned the card from the play deck is calculated by subtracting the shot factor sum for the particular team from the offensive strength index for the particular team minus.

In the event that the gleaned card is found to have a value between one quarter and two points less the shot threshold value for the particular team, a card from the play deck is then collected by the particular team. This collecting step in the hockey card game simulates or represents a first puck pass during an ice hockey match when a team has control over the puck but fails to take a shot at the goal. When the gleaned card is found to have a point value equal to or between one quarter and two point less then the shot threshold value corresponding to the particular team then the gleaned represents a first puck pass made by the particular team. When the collected card from the playing is found to have a point value equal to or greater than to the shot threshold value corresponding to the particular team then the collected card represents a shot taken by the particular team at the opposing teams goal. Another card from the play deck for each of the two opposing teams is drawn when said collecting results in a card that is found to have a point value less than two points below lower then the shot threshold value corresponding to the particular team that collected the collected card.

In the event that the collected card is found to have a point value equal to or between one quarter and two points less than the shot threshold value corresponding to the particular team and when the collected card is found to have a point value less than the point value of the gleaned card, a card from the play deck is extracted by the particular team. The collected card represents a second puck pass in a row made by the particular team when the collected card is found to have a point value equal to or between one quarter and two points less than the shot threshold value corresponding to the particular team and when the collected card is found to have a point value less than the point value of the gleaned card. Also the extracted card represents a shot by the particular team at the opposing teams goal when the extracted card from the playing is found to have a point value greater than or equal to the shot threshold value corresponding to the particular team. When said extracting results in a card that is found to have a point value less than two points lower the shot threshold value corresponding to the particular team that extracted the extracted card then another card is drawn from the play deck for each of the two opposing teams.

In the event that the extracted card is found to have a point value equal to or between one quarter and two points less than the shot threshold value corresponding to the particular team and when the extracted card is found to have a point value less than the point value of the collected card, a card is garnished from the play deck by the particular team. The extracted card represents a third puck pass in a row made by the particular team when the extracted card is found to have a point value equal to or between one quarter and two points less than the shot threshold value corresponding to the particular team and when the extracted card is found to have a point value less than the point value of the collected card. The garnished card represents a shot by the particular team at the opposing teams goal when the garnished card from the playing is found to have a point value greater than or equal to the shot threshold value corresponding to the particular team. When said garnishing results in a card that is found to have a point value less than two points lower the shot threshold value corresponding to the particular team that garnished the garnished card another card is drawn from the play deck for each of the two opposing teams.

In the event that the garnished card is found to have a point value equal to or between one quarter and two points less than the shot threshold value corresponding to the particular team and when the garnished card is found to have a point value less than the point value of the extracted card, then a card is secured from the play deck by the particular team. The garnished card represents a fourth puck pass in a row made by the particular team, when the garnished card is found to have a point value equal to or between one quarter and two points less than the shot threshold value corresponding to the particular team and when the garnished card is found to have a point value less than the point value of the extracted card then. The secured card represents a shot by the particular team at the opposing teams goal when the secured card from the playing is found to have a point value greater than or equal to the shot threshold value corresponding to the particular team. When said securing results in a card that is found to have a point value less than two points lower the shot threshold value corresponding to the particular team that secured the secured card then another card is drawn from the play deck for each of the two opposing teams.

In the event that the secured card is found to have a point value equal to or between one quarter and two points less than the shot threshold value corresponding to the particular team and when the secured card is found to have a point value less than the point value of the garnished card, a card is grabbed from the play deck by the particular team. The secured card represents a fifth puck pass in a row made by the particular team when the secured card is found to have a point value equal to or between one quarter and two points less than the shot threshold value corresponding to the particular team and when the secured card is found to have a point value less than the point value of the garnished card. The grabbed card represents a shot by the particular team at the opposing teams goal when the grabbed card from the playing is found to have a point value greater than or equal to the shot threshold value corresponding to the particular team. When said grabbing results in a card that is found to have a point value less than two points lower the shot threshold value corresponding to the particular team that grabbed the grabbed card another card is drawn from the play deck for each of the two opposing teams.

In the event that the grabbed card is found to have a point value equal to or between one quarter and two points less than the shot threshold value corresponding to the particular team and when the grabbed card is found to have a point value less than the point value of the secured card, then a card is compiled from the play deck by the particular team. The grabbed card represents a sixth puck pass made in a row by the particular team when the grabbed card is found to have a point value equal to or between one quarter and two points less than the shot threshold value corresponding to the particular team and when the grabbed card is found to have a point value less than the point value of the secured card. The compiled card represents a shot by the particular team at the opposing teams goal when the compiled card from the playing is found to have a point value greater than or equal to the shot threshold value corresponding to the particular team. When said compiling results in a card that is found to have a point value less than two points lower the shot threshold value corresponding to the particular team that compiled the compiled card another card is drawn from the play deck for each of the two opposing teams.

In the event that the compiled card is found to have a point value equal to or between one quarter and two points less than the shot threshold value corresponding to the particular team and when the compiled card is found to have a point value less than the point value of the grabbed card, then a card is culled from the play deck by the particular team. The compiled card represents a seventh puck pass made in a row by the particular team when the compiled card is found to have a point value equal to or between one quarter and two points less than the shot threshold value corresponding to the particular team and when the compiled card is found to have a point value less than the point value of the grabbed card. The culled card represents a shot by the particular team at the opposing teams goal when the culled card from the playing is found to have a point value greater than or equal to the shot threshold value corresponding to the particular team. When said culling results in a card that is found to have a point value less than two points lower the shot threshold value corresponding to the particular team that culled the culled card another card is drawn from the play deck for each of the two opposing teams.

In the event that the culled card is found to have a point value equal to or between one quarter and two points less.than the shot threshold value corresponding to the particular team and when the culled card is found to have a point value less than the point value of the compiled card, then a card is gathered from the play deck by the particular team. The culled card represents a eighth puck pass made by the particular team when the culled card is found to have a point value equal to or between one quarter and two points less than the shot threshold value corresponding to the particular team and when the culled card is found to have a point value less than the point value of the compiled card. The gathered card represents a shot by the particular team at the opposing teams goal when the gathered card from the playing is found to have a point value greater than or equal to the shot threshold value corresponding to the particular team. When said gathering results in a card that is found to have a point value less than two points lower the shot threshold value corresponding to the particular team that gathered the gathered card, another card is drawn from the play deck for each of the two opposing teams.

In the event that the particular team gleaned a card that had a point value greater than or equal to the shot threshold value corresponding to the particular team, then a card is acquired from the play deck by the team that did not glean the card that had a point value greater than or equal to the shot threshold value corresponding to the particular team. Designated as the defending team during the round to be the team that did not glean the card that had a point value greater than or equal to the shot threshold value corresponding to the particular team. Designated as the offensive team during the round to be the particular team that gleaned the card that had a point value greater than or equal to the shot threshold value corresponding to the particular team. The said acquiring a card from the play deck by the defending team represents an offensive shot followed by a defensive stance by the goalie in the ice hockey match.

In the present invention of the hockey card game, the goal factor sum for the defending team is then calculating by a running sum of the following factors. The power play goal factor is added to the goal factor sum when the defending team subject to only the minor penalty. The short-handed goal factor is subtracted to the goal factor sum when the offensive team that gleaned the card is subject to the minor penalty or the major penalty. The two-man power play goal factor is added to the goal factor sum when the defending team is subject to the major penalty. The offensive open-net goal factor is added to the goal factor sum when the defending team declared prior to drawing the card from the play deck that it intended to play an open-net offense. The defensive open-net goal factor is subtracted to the goal factor sum when the defending team declared prior to drawing the card from the play deck that it intended to play an open-net offense. The breakaway goal factor is added to the goal factor sum when the offensive team is enabled to be in the breakaway mode of play. Finally, the ace goal factor is added to the goal factor sum when the offensive team gleaned an ace when gleaning the card in the play deck. The defensive block shot threshold criteria is calculated by adding the point value associated with the goalie card for the respective defending team to the goal factor sum.

Scoring a goal in the present invention of the hockey card game by the offensive team is achieved when the acquired card from the play deck by the defending team is found to have a point value less than the defensive block shot threshold criteria associated with the defending team. When the goal is not scored by the offensive team, then the game is continued by drawing a card from the play deck for each of the two opposing teams when said acquiring the acquired card from the play deck by the defending team is found not to have a point value less than the defensive block shot threshold criteria associated with the defending team.

Finally when all of the cards in the play deck are used up the present invention of the hockey card game is ended which represents the entire play during a quarter period during an ice hockey match.

Referring now to the drawings, and in particular FIG. 1 thereof, one preferred embodiment of playing the present invention of the hockey card game 10 is shown. In FIG. 1, a new and improved hockey card game 10 is shown which includes organizing a miscellaneous deck 12, and a play deck onto a table top 16 which can be used to mark down the various calculations that are needed to play the hockey card game 10 as described above. An eraser 18 may be used to erase the marks on the table top 16.

Figure 2:
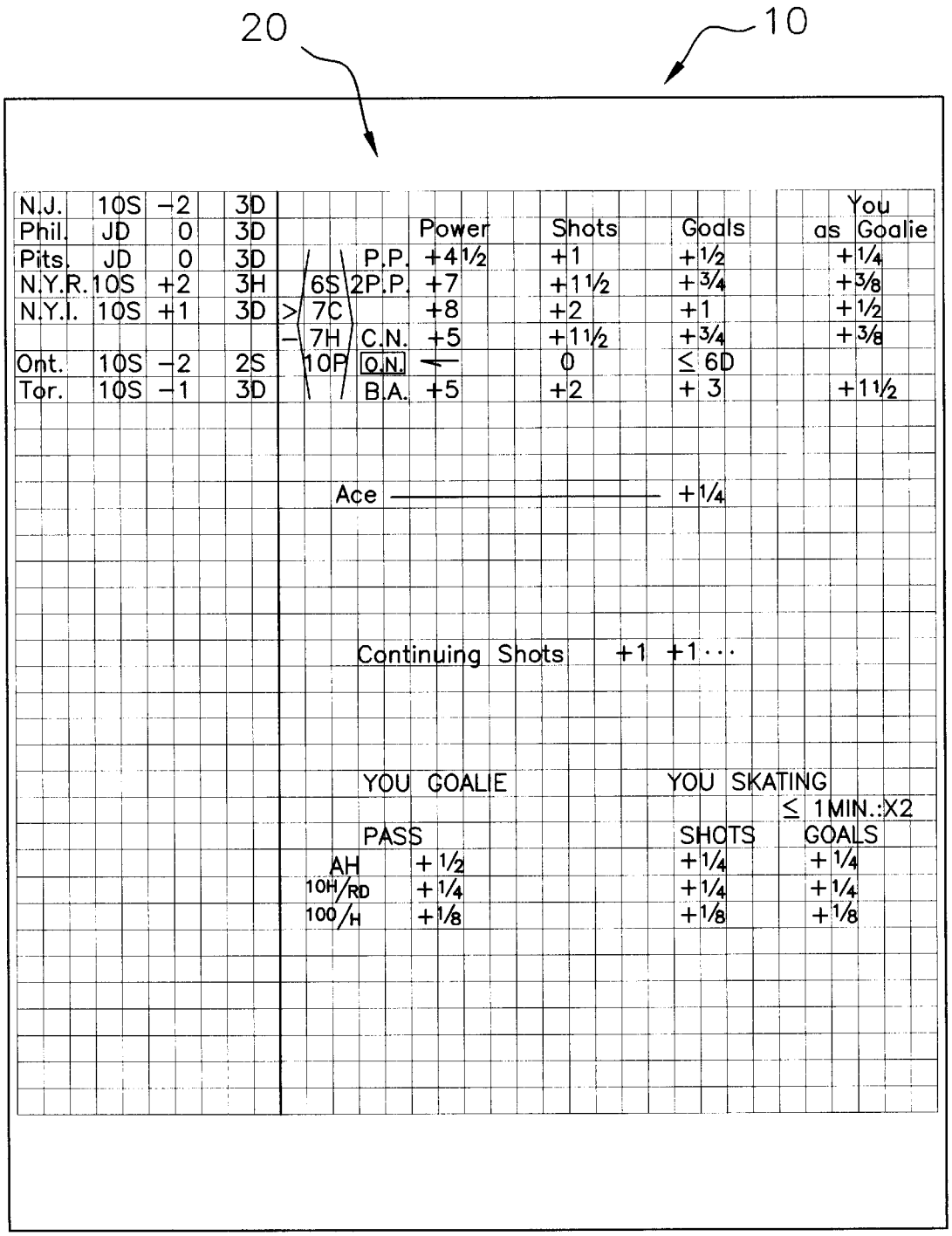
FIG. 2 is a perspective view of graph paper in which the various calculations may be marked down in playing the hockey card game of the present invention.

Referring now to FIG. 2, another preferred embodiment of playing the present invention of the hockey card game 10 is shown. Graph paper 20 may be used to mark down the various calculations that are needed to play the hockey card game 10 as described above.

As to the manner of usage and operation of the present invention, the same should be apparent from the above description. Accordingly, no further discussion relating to the manner of usage and operation will be provided.

While a preferred embodiment of the hockey card game has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hockey card game for teaching applied mathematics and for enjoying a simulated ice hockey match against two opposing teams played by at least one player, said hockey card game comprising:

assigning each card in a standard fifty two card deck a unique point value, wherein the two of diamonds is assigned a point value of 2,
the two of hearts is assigned a point value of 2.25,
the two of clubs is assigned a point value of 2.5,
the two of spades is assigned a point value of 2.75,
the three of diamonds is assigned a point value of 3;
the three of hearts is assigned a point value of 3.25,
the three of clubs is assigned a point value of 3.5,
the three of spades is assigned a point value of 3.75,
the four of diamonds is assigned a point value of 4,
the four of hearts is assigned a point value of 4.25,
the four of clubs is assigned a point value of 4.5,
the four of spades is assigned a point value of 4.75,
the five of diamonds is assigned a point value of 5,
the five of hearts is assigned a point value of 5.25.
the five of clubs is assigned a point value of 5.5,
the five of spades is assigned a point value of 5.75,
the six of diamonds is assigned a point value of 6,
the six of hearts is assigned a point value of 6.25,
the six of clubs is assigned a point value of 6.5,
the six of spades is assigned a point value of 6.75,
the seven of diamonds is assigned a point value of 7,
the seven of hearts is assigned a point value of 7.25,
the seven of clubs is assigned a point value of 7.50,
the seven of spades is assigned a point value of 7.75,
the eight of diamonds is assigned a point value of 8,
the eight of hearts is assigned a point value of 8.25,
the eight of clubs is assigned a point value of 8.5,
the eight of spades is assigned a point value of 8.75,
the nine of diamonds is assigned a point value of 9,
the nine of hearts is assigned a point value of 9.25,
the nine of clubs is assigned a point value of 9.5,
the nine of spades is assigned a point value of 9.75,
the ten of diamonds is assigned a point value of 10,
the ten of hearts is assigned a point value of 10.25,
the ten of clubs is assigned a point value of 10.5,
the ten of spades is assigned a point value of 10.75,
the jack of diamonds is assigned a point value of 11,
the jack of hearts is assigned a point value of 11.25,
the jack of clubs is assigned a point value of 11.50,
the jack of spades is assigned a point value of 11.75,
the queen of diamonds is assigned a point value of 12,
the queen of hearts is assigned a point value of 12.25,
the queen of clubs is assigned a point value of 12.50,
the queen of spades is assigned a point value of 12.75,
the king of diamonds is assigned a point value of 13,
the king of hearts is assigned a point value of 13.25,
the king of clubs is assigned a point value of 13.50,
the king of spades is assigned a point value of 13.75,
the ace of diamonds is assigned a point value of 15,
the ace of hearts is assigned a point value of 15.25,
the ace of clubs is assigned a point value of 15.50, and
the ace of spades is assigned a point value of 15.75;

designating each card in the standard fifty two card deck a unique probability threshold value, wherein the two of diamonds is designated a probability threshold value of 1/52,
the two of hearts is designated a probability threshold value of 2/52,
the two of clubs is designated a probability threshold value of 3/52,
the two of spades is designated a probability threshold value of 4/52,
the three of diamonds is designated a probability threshold value of 5/52,
the three of hearts is designated a probability threshold value of 6/52,
the three of clubs is designated a probability threshold value of 7/52,
the three of spades is designated a probability threshold value of 8/52,
the four of diamonds is designated a probability threshold value of 9/52,
the four of hearts is designated a probability threshold value of 10/52,
the four of clubs is designated a probability threshold value of 11/52,
the four of spades is designated a probability threshold value of 12/52,
the five of diamonds is designated a probability threshold value of 13/52,
the five of hearts is designated a probability threshold value of 14/52,
the five of clubs is designated a probability threshold value of 15/52,
the five of spades is designated a probability threshold value of 16/52,
the six of diamonds is designated a probability threshold value of 17/52,
the six of hearts is designated a probability threshold value of 18/52,
the six of clubs is designated a probability threshold value of 19/52,
the six of spades is designated a probability threshold value of 20/52,
the seven of diamonds is designated a probability threshold value of 21/52,
the seven of hearts is designated a probability threshold value of 22/52,
the seven of clubs is designated a probability threshold value of 23/52, the seven of spades is designated a probability threshold value of 24/52,
the eight of diamonds is designated a probability threshold value of 25/52,
the eight of hearts is designated a probability threshold value of 26/52,
the eight of clubs is designated a probability threshold value of 27/52,
the eight of spades is designated a probability threshold value of 28/52,
the nine of diamonds is designated a probability threshold value of 29/52,
the nine of hearts is designated a probability threshold value of 30/52,
the nine of clubs is designated a probability threshold value of 31/52,
the nine of spades is designated a probability threshold value of 32/52,
the ten of diamonds is designated a probability threshold value of 33/52,
the ten of hearts is designated a probability threshold value of 34/52,
the ten of clubs is designated a probability threshold value of 35/52,
the ten of spades is designated a probability threshold value of 36/52,
the jack of diamonds is designated a probability threshold value of 37/52,
the jack of hearts is designated a probability threshold value of 38/52,
the jack of clubs is designated a probability threshold value of 39/52,
the jack of spades is designated a probability threshold value of 40/52,
the queen of diamonds is designated a probability threshold value of 41/52,
the queen of hearts is designated a probability threshold value of 42/52,
the queen of clubs is designated a probability threshold value of 43/52,
the queen of spades is designated a probability threshold value of 44/52,
the king of diamonds is designated a probability threshold value of,45/52
the king of hearts is designated a probability threshold value of 46/52,
the king of clubs is designated a probability threshold value of 47/52,
the king of spades is designated a probability threshold value of 48/52,
the ace of diamonds is designated a probability threshold value of 49/52,
the ace of hearts is designated a probability threshold value of 50/52,
the ace of clubs is designated a probability threshold value of 45/52, and
the ace of spades is designated a probability threshold value of 52/52;

allotting each card in the standard fifty two playing card deck a unique hierarchy value, wherein
the two of diamonds is allotted a card hierarchy value of 1,
the two of hearts is allotted a card hierarchy value of 2,
the two of clubs is allotted a card hierarchy value of 3,
the two of spades is allotted a card hierarchy value of 4,
the three of diamonds is allotted a card hierarchy value of 5;
the three of hearts is allotted a card hierarchy value of 6,
the three of clubs is allotted a card hierarchy value of 7,
the three of spades is allotted a card hierarchy value of 8,
the four of diamonds is allotted a card hierarchy value of 9,
the four of hearts is allotted a card hierarchy value of 10,
the four of clubs is allotted a card hierarchy value of 11,
the four of spades is allotted a card hierarchy value of 12,
the five of diamonds is allotted a card hierarchy value of 13,
the five of hearts is allotted a card hierarchy value of 14,
the five of clubs is allotted a card hierarchy value of 15,
the five of spades is allotted a card hierarchy value of 16,
the six of diamonds is allotted a card hierarchy value of 17,
the six of hearts is allotted a card hierarchy value of 18,
the six of clubs is allotted a card hierarchy value of 19,
the six of spades is allotted a card hierarchy value of 20,
the seven of diamonds is allotted a card hierarchy value of 21,
the seven of hearts is allotted a card hierarchy value of 22,
the seven of clubs is allotted a card hierarchy value of 23,
the seven of spades is allotted a card hierarchy value of 24,
the eight of diamonds is allotted a card hierarchy value of 25,
the eight of hearts is allotted a card hierarchy value of 26,
the eight of clubs is allotted a card hierarchy value of 27,
the eight of spades is allotted a card hierarchy value of 28,
the nine of diamonds is allotted a card hierarchy value of 29,
the nine of hearts is allotted a card hierarchy value of 30,
the nine of clubs is allotted a card hierarchy value of 32,
the nine of spades is allotted a card hierarchy value of 32,
the ten of diamonds is allotted a card hierarchy value of 33,
the ten of hearts is allotted a card hierarchy value of 34,
the ten of clubs is allotted a card hierarchy value of 35,
the ten of spades is allotted a card hierarchy value of 36,
the jack of diamonds is allotted a card hierarchy value of 37,
the jack of hearts is allotted a card hierarchy value of 38,
the jack of clubs is allotted a card hierarchy value of 39,
the jack of spades is allotted a card hierarchy value of 40,
the queen of diamonds is allotted a card hierarchy value of 41,
the queen of hearts is allotted a card hierarchy value of 42,
the queen of clubs is allotted a card hierarchy value of 43,
the queen of spades is allotted a card hierarchy value of 44, the king of diamonds is allotted a card hierarchy value of 45, the king of hearts is allotted a card hierarchy value of 46, the king of clubs is allotted a card hierarchy value of 47, the king of spades is allotted a card hierarchy value of 48, the ace of diamonds is allotted a card hierarchy value of 49, the ace of hearts is allotted a card hierarchy value of 50, the ace of clubs is allotted a card hierarchy value of 51, and the ace of spades is allotted a card hierarchy value of 52;

calculating a win-tie index for each particular team, wherein the win-tie index for each particular team is calculated by adding the total number of ties the corresponding ice hockey team achieved in the previous season to two times the total number of wins the corresponding ice hockey team achieved in the previous season;

designating one of the opposing teams as a home team and the other opposing team as a visitor team;

calculating a power index for each particular team, wherein the power index for each particular team is the win-tie index for each particular team plus ten points if the particular team is designated as the home team and minus ten points if the particular team is designated as the visitor team;

calculating a relative power factor, wherein the relative power factor is calculated by taking the absolute value of the difference in the power indexes of each team and dividing this absolute value by twenty five, and then rounding the quotient to the nearest one-quarter point;

calculating a goalie strength index for each particular team, wherein the goalie strength index for each particular team is calculated by dividing the total number of saves achieved by the corresponding ice hockey team in the previous season by the total number of shots attempted against the goal of the corresponding ice hockey team in the previous season;

calculating a goalie susceptibility index for each particular team, wherein the goalie susceptibility index for each particular team is calculated by subtracting the corresponding goalie strength index of each particular team from one;

assigning a goalie card for each particular team, wherein the goalie card for each particular team is assigned to the playing card having a probability threshold value closest to the goalie susceptibility index for the respective team;

assigning a defensive threshold value for each particular team to be the point value associated with the goalie card for the respective team;

calculating an offensive strength index for each particular team by subtracting the average number of shots per game that the corresponding ice hockey team attempted in the previous season from an offensive weight factor, wherein said offensive weight factor is assigned a valued of at least fifty two;

identifying an offensive strength threshold card for each particular team to be the card that is associated with the card hierarchy value that most closely matches the offensive strength index for each particular team;

assigning an offensive strength threshold card value for each particular team to be the point value corresponding to the offensive strength threshold card for each particular team;

assigning a power play control factor, wherein the power play control factor is assigned a value of at least a 3 points;

assigning a power play shot factor, wherein the power play shot factor is assigned a value of at least 1 point;

assigning a power play goal factor, wherein the power play goal factor is assigned a value of at least a ¼ point;

assigning a short-handed shot factor, wherein the short-handed shot factor is assigned a value of at least 1 point;

assigning a short-handed goal factor, wherein the short-handed goal factor is assigned a value of at least ¼ point;

assigning a two-man power play control factor, wherein the two-man power play control factor is assigned a value of at least 4 points;

assigning a two-man power play shot factor, wherein the two-man power play shot factor is assigned a value of at least 1 point;

assigning a two-man power play goal factor, wherein the two-man power play goal factor is assigned a value of at least ¼ point;

assigning an offensive open-net control factor, wherein the open-net control factor is assigned a value of at least 3 points;

assigning an offensive open-net shot factor, wherein the open-net shot factor is assigned a value of at least 1 point;

assigning an offensive open-net goal factor, wherein the open-net goal factor is assigned a value of at least ¼ point;

assigning a defensive open-net shot factor, wherein the defensive-open net shot factor is assigned a value of at least 1 point;

assigning a defensive open-net goal factor, wherein the defensive-open net goal factor is assigned a value of at least 4 points;

assigning a breakaway control factor, wherein the breakaway control factor is assigned a value of at least 3 points;

assigning a breakaway shot factor, wherein the breakaway shot factor is assigned a value of at least 1 point;

assigning a breakaway goal factor, wherein the breakaway goal factor is assigned a value of at least ½ point;

assigning an ace goal factor; wherein the ace goal factor is assigned a value of at least ¼ point;

assigning at least one penalty card, wherein the penalty card is assigned to be at least the two of diamonds;

assigning at least one penalty shot card, wherein the penalty shot card is assigned to be at least the ace of diamonds;

assigning a time segment associated with each play, wherein the time segment is assigned to represent 6 seconds of play time in the ice hockey match;

combining three standard fifty two playing card decks randomly together to form a combined deck;

assembling a play deck comprising one hundred and six playing cards from the combined deck;

making a miscellaneous deck comprising fifty playing cards from the combined deck;

declaring if any one of the opposing teams will play a round in an open net offense mode of play, wherein said declaring is declared by the team that intends to play the round as an open net offense mode of play;

drawing one card from the play deck for each of the two opposing teams;

pulling one card from the miscellaneous deck when the drawn card is the penalty card, wherein said pulling is performed by the team that drew the penalty card from the play deck;

receiving a major penalty when the pulled card from the miscellaneous deck is also the penalty card, wherein the major penalty is received by the team that drew the penalty card from the play deck and pulled the penalty card from the miscellaneous deck, wherein the major penalty enables the non-penalized team to use the power play mode of play for 50 turns in the hockey sports game when the penalized team is subjected to one penalty, and wherein the major penalty enables the non-penalized team to use the two man power play mode of play for up to 49 turns in the hockey card game when the penalized team is subjected to two or more penalties, whereby the major penalty represents an ice hockey player being placed on the bench for five minutes during an ice hockey match;

obtaining a minor penalty when the pulled card from the miscellaneous deck is not the penalty card, wherein the minor penalty is obtained by the team that drew the penalty card from the play deck and pulled the card from the miscellaneous deck which was not the penalty card, wherein the minor penalty enables the non-penalized team to use the power play mode of play for up to 20 turns in the hockey sports game when the penalized team is subject to one penalty, wherein the minor penalty enables the non-penalized team to use the double man power play mode of play for up to 19 turns in the hockey sports game when the penalized team is subjected to two or more penalties, and wherein the minor penalty is lifted against the penalized team in the event that the non-penalized team scores a goal within the 20 turns associated with the penalized team obtaining the minor penalty, whereby the minor penalty represents the situation in the ice hockey match when the ice hockey player is taken out of the ice hockey match and placed on the bench for up to two minutes during the ice hockey match or until the non-penalized ice hockey team scores an goal;

getting a penalty shot possibility imposed against the penalized team when the pulled card from the miscellaneous deck is the penalty shot card, wherein the team that gets the penalty shot possibility imposed against it is the team that drew penalty card from the play deck and pulled the penalty shot card from the miscellaneous deck;

taking one card from the miscellaneous deck by the non-penalized team after the penalty shot possibility is imposed against the penalized team to determine when the non-penalized team is able to control the puck, wherein the non-penalized team is the team that did not draw the penalty card from the play deck nor pulled the penalty shot card from the miscellaneous deck;

calculating a penalty shot threshold criteria for the non-penalized team by subtracting the breakaway shot factor from the offensive strength threshold value associated with the non-penalized team;

making a penalty shot when the point value of the card taken from the miscellaneous deck by the non-penalized team is greater than or equal to the point value of the penalty shot threshold criteria for the non-penalized team;

selecting one card from the miscellaneous deck by the penalized team when the penalty shot is made by the non-penalized team, wherein the penalized team is the team that drew the penalty card from the play deck and got the penalty shot card from the miscellaneous deck;

calculating a goalie block shot threshold criteria for the penalized team by adding the breakaway goal factor to the defensive threshold value associated with the penalized team;

scoring a goal from a penalty shot when the value of the card selected from the miscellaneous deck is less than the goalie block shot threshold criteria for the penalized team;

picking one card from the miscellaneous deck for each opposing team when any card drawn from the play deck is an ace;

summing the point value of the corresponding drawn card to the point value of the corresponding picked card for each opposing team;

finding the difference in the point value sums of the drawn card and the picked card between the opposing teams;

enabling the team that drew the ace from the play deck to be in a breakaway mode of play when the difference in the point value sums of the drawn card and the picked card between the opposing teams is found to be greater than or equal to fourteen;

accruing a card from the play deck for each for the opposing teams when both teams are found to have drawn cards that have point values greater than their respective control threshold values;

unenabling the breakaway mode of play when both teams are found to have drawn cards that have point values greater than their respective control threshold values;

choosing a card from the miscellaneous deck for each opposing team when any card accrued from the play deck is an ace;

summing the point value of the corresponding accrued card to the point value of the corresponding chosen card for each opposing team;

finding the difference in the point value sums of the accrued card and the chosen card between the opposing teams, enabling the team that accrued the ace from the play deck to be in a breakaway mode of play when the difference in the point value sums of the accrued card and the chosen card is found to be greater than or equal to fourteen;

retrieving a card from the play deck for each for the opposing teams when both teams are found to have both drawn cards that have point values less than their respective control threshold values;

unenabling the breakaway mode of play when both teams are found to have drawn cards that have point values greater than their respective control threshold values;

obtaining a card from the miscellaneous deck from each opposing team when any card accrued from the play deck is an ace;

summing the point value of the corresponding retrieved card to the point value of the obtained corresponding obtained card for each opposing team;

finding the difference in the point value sums of the retrieved card and the obtained card between the opposing teams;

enabling the team that retrieved the ace from the play deck to be in a breakaway mode of play when the difference in the point value sums of the retrieved card and the obtained card is found to be greater than or equal to fourteen;

calculating a control factor sum for each opposing team, wherein the relative power factor is added to the control factor sum of the particular team when the particular team has been determined to be the team associated with having the larger of the two power indexes between the two opposing teams, wherein the power play control factor is added to the control factor sum of the particular team when the team opposing the particular team is subject to only the minor penalty, wherein the two-man power play control factor is added to the control factor sum of the particular team when the team opposing the particular team is subject to the major penalty, wherein the open net control factor is added to the control factor sum of the particular team when the particular team declared prior to drawing the card from the play deck that it intended to play an open-net offense, and wherein the breakaway control factor is added to the control factor sum of the particular team when the particular team is enabled in the breakaway mode of play;

determining which team is associated with the larger of the two control factor sums;

finding the absolute value of the difference in the control factor sums between the two opposing teams;

calculating a control threshold value for each opposing team, wherein the control threshold value for the particular team that is determined to be the team associated with the larger of the two control factor sums is the absolute value of the difference in the control factor sums between the two opposing teams, and wherein the control threshold value for the particular team that was not determined to be the team associated with the larger of the two control factor sums is zero;

gleaning a card from the play deck by a particular team when the card drawn by the particular team is found to have a point value greater than the control threshold value associated with the particular team and when the opposing team is found to have drawn a card from the play deck that has a point value less than the control threshold value associated with the opposing team, whereby said gleaning represents winning offensive control of the puck in the ice hockey match followed by an attempted offensive shot at the goal;

gleaning a card from the play deck by a particular team when the card accrued by the particular team is found to have a point value greater than the control threshold value associated with the particular team and when the opposing team is found to have accrued a card from the play deck that has a point value less than the control threshold value associated with the opposing team, whereby said gleaning represents winning offensive control of the puck in the ice hockey match followed by an attempted offensive shot at the goal;

gleaning a card from the play deck by a particular team when the card retrieved by the particular team is found to have a point value greater than the control threshold value associated with the particular team and when the opposing team is found to have retrieved a card from the play deck that has a point value less than the control threshold value associated with the opposing team, whereby said gleaning represents winning offensive control of the puck in the ice hockey match followed by an attempted offensive shot at the goal;

calculating a shot factor sum for the particular team that gleaned the card from the play deck, wherein the power play shot factor is added to the shot factor sum when the team opposing the particular team is subject to the minor penalty, wherein the short handed shot factor is added to the shot factor sum when the particular team is the penalized team;

wherein the two-man power play control factor is added to the shot factor sum when the team opposing the particular team is subject to the major penalty, wherein the open net shot factor is added to the shot factor sum when the team opposing the particular team declared prior to drawing the card from the play deck that it intended to play an open-net offense, and wherein the defensive open net shot factor is added to the shot factor sum when the team that did not glean the card from the play deck is also the team that declared that it would play a round in the open net offense mode of play, and wherein the breakaway shot factor is added to the shot factor sum when the particular team is enabled to be in the breakaway mode of play;

calculating a shot threshold value for the particular team that gleaned the card from the play deck, wherein the shot threshold value for the particular team is the offensive strength index for the particular team minus the shot factor sum for the particular team;

wherein when a gleaned card is found to have a point value greater than or equal to the shot threshold value, the gleaned card represents a shot taken by the particular team at the opposing teams goal;

collecting a card from the play deck by the particular team when the gleaned card is found to have a point value equal to or between one quarter and two points less then the shot threshold value corresponding to the particular team, wherein when the gleaned card is found to have a point value equal to or between one quarter and two point less then the shot threshold value corresponding to the particular team then the gleaned represents a first puck pass made by the particular team, wherein when the collected card from the playing is found to have a point value equal to or greater than to the shot threshold value corresponding to the particular team then the collected card represents a shot taken by the particular team at the opposing teams goal;

drawing another card from the play deck for each of the two opposing teams when said collecting results in a card that is found to have a point value less than two points below lower then the shot threshold value corresponding to the particular team that collected the collected card;

extracting a card from the play deck by the particular team when the collected card is found to have a point value equal to or between one quarter and two points less than the shot threshold value corresponding to the particular team and when the collected card is found to have a point value less than the point value of the gleaned card, wherein when the collected card is found to have a point value equal to or between one quarter and two points less than the shot threshold value corresponding to the particular team and when the collected card is found to have a point value less than the point value of the gleaned card then the collected card represents a second puck pass made by the particular team;

wherein when the extracted card from the playing is found to have a point value greater than or equal to the shot threshold value corresponding to the particular team then the extracted card represents a shot by the particular team at the opposing teams goal;

drawing another card from the play deck for each of the two opposing teams when said extracting results in a card that is found to have a point value less than two points lower the shot threshold value corresponding to the particular team that extracted the extracted card;

garnishing a card from the play deck by the particular team when the extracted card is found to have a point value equal to or between one quarter and two points less than the shot threshold value corresponding to the particular team and when the extracted card is found to have a point value less than the point value of the collected card, wherein when the extracted card is found to have a point value equal to or between one quarter and two points less than the shot threshold value corresponding to the particular team and when the extracted card is found to have a point value less than the point value of the collected card then the extracted card represents a third puck pass made by the particular team;

wherein when the garnished card from the playing is found to have a point value greater than or equal to the shot threshold value corresponding to the particular team then the garnished card represents a shot by the particular team at the opposing teams goal;

drawing another card from the play deck for each of the two opposing teams when said garnishing results in a card that is found to have a point value less than two points lower the shot threshold value corresponding to the particular team that garnished the garnished card;

securing a card from the play deck by the particular team when the garnished card is found to have a point value equal to or between one quarter and two points less than the shot threshold value corresponding to the particular team and when the garnished card is found to have a point value less than the point value of the extracted card, wherein when the garnished card is found to have a point value equal to or between one quarter and two points less than the shot threshold value corresponding to the particular team and when the garnished card is found to have a point value less than the point value of the extracted card then the garnished card represents a fourth puck pass made by the particular team;

wherein when the secured card from the playing is found to have a point value greater than or equal to the shot threshold value corresponding to the particular team then the secured card represents a shot by the particular team at the opposing teams goal;

drawing another card from the play deck for each of the two opposing teams when said securing results in a card that is found to have a point value less than two points lower the shot threshold value corresponding to the particular team that secured the secured card;

grabbing a card from the play deck by the particular team when the secured card is found to have a point value equal to or between one quarter and two points less than the shot threshold value corresponding to the particular team and when the secured card is found to have a point value less than the point value of the garnished card, wherein when the secured card is found to have a point value equal to or between one quarter and two points less than the shot threshold value corresponding to the particular team and when the secured card is found to have a point value less than the point value of the garnished card then the secured card represents a fifth puck pass made by the particular team;

wherein when the grabbed card from the playing is found to have a point value greater than or equal to the shot threshold value corresponding to the particular team then the grabbed card represents a shot by the particular team at the opposing teams goal;

drawing another card from the play deck for each of the two opposing teams when said grabbing results in a card that is found to have a point value less than two points lower the shot threshold value corresponding to the particular team that grabbed the grabbed card;

compiling a card from the play deck by the particular team when the grabbed card is found to have a point value equal to or between one quarter and two points less than the shot threshold value corresponding to the particular team and when the grabbed card is found to have a point value less than the point value of the secured card, wherein when the grabbed card is found to have a point value equal to or between one quarter and two points less than the shot threshold value corresponding to the particular team and when the grabbed card is found to have a point value less than the point value of the secured card then the grabbed card represents a sixth puck pass made by the particular team;

wherein when the compiled card from the playing is found to have a point value greater than or equal to the shot threshold value corresponding to the particular team then the compiled card represents a shot by the particular team at the opposing teams goal;

drawing another card from the play deck for each of the two opposing teams when said compiling results in a card that is found to have a point value less than two points lower the shot threshold value corresponding to the particular team that compiled the compiled card;

culling a card from the play deck by the particular team when the compiled card is found to have a point value equal to or between one quarter and two points less than the shot threshold value corresponding to the particular team and when the compiled card is found to have a point value less than the point value of the grabbed card, wherein when the compiled card is found to have a point value equal to or between one quarter and two points less than the shot threshold value corresponding to the particular team and when the compiled card is found to have a point value less than the point value of the grabbed card then the compiled card represents a seventh puck pass made by the particular team;

wherein when the culled card from the playing is found to have a point value greater than or equal to the shot threshold value corresponding to the particular team then the culled card represents a shot by the particular team at the opposing teams goal;

drawing another card from the play deck for each of the two opposing teams when said culling results in a card that is found to have a point value less than two points lower the shot threshold value corresponding to the particular team that culled the culled card;

gathering a card from the play deck by the particular team when the culled card is found to have a point value equal to or between one quarter and two points less than the shot threshold value corresponding to the particular team and when the culled card is found to have a point value less than the point value of the compiled card, wherein when the culled card is found to have a point value equal to or between one quarter and two points less than the shot threshold value corresponding to the particular team and when the culled card is found to have a point value less than the point value of the compiled card then the culled card represents a eighth puck pass made by the particular team;

wherein when the gathered card from the playing is found to have a point value greater than or equal to the shot threshold value corresponding to the particular team then the gathered card represents a shot by the particular team at the opposing teams goal;

drawing another card from the play deck for each of the two opposing teams when said gathering results in a card that is found to have a point value less than two points lower the shot threshold value corresponding to the particular team that gathered the gathered card;

acquiring a card from the play deck by the team that did not glean the card that had a point value greater than or equal to the shot threshold value corresponding to the particular team, wherein said acquiring the card from the play deck is acquired after the particular team gleaned a card that had a point value greater than or equal to the shot threshold value corresponding to the particular team, wherein the team that did not glean the card that had a point value greater than or equal to the shot threshold value corresponding to the particular team is designated as the defending team;

wherein the particular team that gleaned the card that had a point value greater than or equal to the shot threshold value corresponding to the particular team is designated as the offensive team, wherein said acquiring by the defending team represents an offensive shot followed by a defensive stance by the goalie in the ice hockey match;

calculating a goal factor sum for the defending team, wherein the power play goal factor is added to the goal factor sum when the defending team subject to only the minor penalty, wherein the short-handed goal factor is subtracted to the goal factor sum when the offensive team that gleaned the card is subject to the minor penalty or the major penalty, wherein the two-man power play goal factor is added to the goal factor sum when the defending team is subject to the major penalty, wherein the offensive open-net goal factor is added to the goal factor sum when the defending team declared prior to drawing the card from the play deck that it intended to play an open-net offense, wherein the defensive open-net goal factor is subtracted to the goal factor sum when the defending team declared prior to drawing the card from the play deck that it intended to play an open-net offense, wherein the breakaway goal factor is added to the goal factor sum when the offensive team is enabled to be in the breakaway mode of play, and wherein the ace goal factor is added to the goal factor sum when the offensive team gleaned an ace when gleaning the card in the play deck;

calculating a defensive block shot threshold criteria by adding the point value associated with the goalie card for the respective defending team to the goal factor sum;

scoring a goal by the offensive team when the acquired card from the play deck by the defending team is found to have a point value less than the defensive block shot threshold criteria associated with the defending team;

drawing a card from the play deck for each of the two opposing teams when said acquiring the acquired card from the play deck by the defending team is found not to have a point value less than the defensive block shot threshold criteria associated with the defending team; and using up all of the cards in the play deck, wherein said using represents the entire play during a quarter of the ice hockey match.

2. The hockey card game described in claim 1, wherein the offensive weight factor is 62.

wherein the power play control factor is 3 points;

wherein the power play shot factor is 2 points;

wherein the power play goal factor is ½ point;

wherein the short-handed shot factor is 2 points;

wherein the short-handed goal factor is ¼ point;

wherein the two-man power play control factor 4 points;

wherein the two-man power play shot factor is 2 points;

wherein the two-man power play goal factor is ¾ point;

wherein the open-net control factor is 3 points;

wherein the open-net shot factor is 2 points;

wherein the open-net goal factor is ½ point;

wherein the defensive-open net shot factor is 2 points;

wherein the defensive-open net goal factor is 7 points;

wherein the breakaway control factor is 4 points;

wherein the breakaway shot factor is 4 points;

wherein the breakaway goal factor is 3 points; and wherein the ace goal factor is ¼ point.

3. The hockey card game described in claim 1, wherein the offensive weight factor is 62.

wherein the power play control factor is 4 points;

wherein the power play shot factor is 2 points;

wherein the power play goal factor is ½ point;

wherein the short-handed shot factor is 2 points;

wherein the short-handed goal factor is ¼ point;

wherein the two-man power play control factor 6 points;
wherein the two-man power play shot factor is 2 points;
wherein the two-man power play goal factor is ¾ point;
wherein the open-net control factor is 5 points;
wherein the open-net shot factor is 2 points;
wherein the open-net goal factor is ½ point;
wherein the defensive-open net shot factor is 2 points;
wherein the defensive-open net goal factor is 7 points;
wherein the breakaway control factor is 5 points;
wherein the breakaway shot factor is 4 points;
wherein the breakaway goal factor is 3 points; and
wherein the ace goal factor is ¼ point.

4. The hockey card game described in claim 1,
wherein the offensive weight factor is 62,
wherein the power play control factor is 4 points;
wherein the power play shot factor is 2 points;
wherein the power play goal factor is ½ point;
wherein the short-handed shot factor is 2 points;
wherein the short-handed goal factor is ¾ point;
wherein the two-man power play control factor 5 points;
wherein the two-man power play shot factor is 2 points;
wherein the two-man power play goal factor is ¾ point;
wherein the open-net control factor is 5 points;
wherein the open-net shot factor is 2 points;
wherein the open-net goal factor is ½ point;
wherein the defensive-open net shot factor is 2 points;
wherein the defensive-open net goal factor is 7 points;
wherein the breakaway control factor is 5 points;
wherein the breakaway shot factor is 4 points;
wherein the breakaway goal factor is 3 points; and
wherein the ace goal factor is ¼ point.

5. The hockey card game described in claim 1,
wherein the offensive weight factor is 62,
wherein the power play control factor is 4½ points;
wherein the power play shot factor is 1 points;
wherein the power play goal factor is ¼ point;
wherein the short-handed shot factor is 2 points;
wherein the short-handed goal factor is ¼ point;
wherein the two-man power play control factor 7 points;
wherein the two-man power play shot factor is 1½ points;
wherein the two-man power play goal factor is ¾ point;
wherein the o pen-net control factor is 3 points;
wherein the open-net shot factor is 2 points;
wherein the open-net goal factor is ½ point;
wherein the defensive-open net shot factor is 0 points;
wherein the defensive-open net goal factor is 6 points;
wherein the breakaway control factor is 5 points;
wherein the breakaway shot factor is 2 points;
wherein the breakaway goal factor is 3 points; and
wherein the ace goal factor is ¼ point.

6. A hockey card game for teaching applied mathematics and for enjoying a simulated ice hockey match against two opposing teams played by at least one player, said hockey card game comprising:

assigning each card in a standard fifty two card deck a unique point value, wherein
the two of diamonds is assigned a point value of 2,
the two of hearts is assigned a point value of 2.25,
the two of clubs is assigned a point value of 2.5,
the two of spades is assigned a point value of 2.75,
the three of diamonds is assigned a point value of 3;
the three of hearts is assigned a point value of 3.25,
the three of clubs is assigned a point value of 3.5,
the three of spades is assigned a point value of 3.75,
the four of diamonds is assigned a point value of 4,
the four of hearts is assigned a point value of 4.25,
the four of clubs is assigned a point value of 4.5,
the four of spades is assigned a point value of 4.75,
the five of diamonds is assigned a point value of 5,
the five of hearts is assigned a point value of 5.25,
the five of clubs is assigned a point value of 5.5,
the five of spades is assigned a point value of 5.75,
the six of diamonds is assigned a point value of 6,
the six of hearts is assigned a point value of 6.25,
the six of clubs is assigned a point value of 6.5,
the six of spades is assigned a point value of 6.75,
the seven of diamonds is assigned a point value of 7,
the seven of hearts is assigned a point value of 7.25,
the seven of clubs is assigned a point value of 7.50,
the seven of spades is assigned a point value of 7.75,
the eight of diamonds is assigned a point value of 8,
the eight of hearts is assigned a point value of 8.25,
the eight of clubs is assigned a point value of 8.5,
the eight of spades is assigned a point value of 8.75,
the nine of diamonds is assigned a point value of 9,
the nine of hearts is assigned a point value of 9.25,
the nine of clubs is assigned a point value of 9.5,
the nine of spades is assigned a point value of 9.75,
the ten of diamonds is assigned a point value of 10,
the ten of hearts is assigned a point value of 10.25,
the ten of clubs is assigned a point value of 10.5,
the ten of spades is assigned a point value of 10.75,
the jack of diamonds is assigned a point value of 11,
the jack of hearts is assigned a point value of 11.25,
the jack of clubs is assigned a point value of 11.50,
the jack of spades is assigned a point value of 11.75,
the queen of diamonds is assigned a point value of 12,
the queen of hearts is assigned a point value of 12.25,
the queen of clubs is assigned a point value of 12.50,
the queen of spades is assigned a point value of 12.75,
the king of diamonds is assigned a point value of 13,
the king of hearts is assigned a point value of 13.25,
the king of clubs is assigned a point value of 13.50,
the king of spades is assigned a point value of 13.75,
the ace of diamonds is assigned a point value of 15,
the ace of hearts is assigned a point value of 15.25,
the ace of clubs is assigned a point value of 15.50, and
the ace of spades is assigned a point value of 15.75;

designating each card in the standard fifty two card deck a unique probability threshold value, wherein
the two of diamonds is designated a probability threshold value of 1/52,
the two of hearts is designated a probability threshold value of 2/52,
the two of clubs is designated a probability threshold value of 3/52,
the two of spades is designated a probability threshold value of 4/52,
the three of diamonds is designated a probability threshold value of 5/52,
the three of hearts is designated a probability threshold value of 6/52,
the three of clubs is designated a probability threshold value of 7/52,
the three of spades is designated a probability threshold value of 8/52, the four of diamonds is designated a probability threshold value of 9/52,
the four of hearts is designated a probability threshold value of 10/52,
the four of clubs is designated a probability threshold value of 11/52,
the four of spades is designated a probability threshold value of 12/52,
the five of diamonds is designated a probability threshold value of 13/52,
the five of hearts is designated a probability threshold value of 14/52,
the five of clubs is designated a probability threshold value of 15/52,
the five of spades is designated a probability threshold value of 16/52,
the six of diamonds is designated a probability threshold value of 17/52,
the six of hearts is designated a probability threshold value of 18/52,
the six of clubs is designated a probability threshold value of 19/52,
the six of spades is designated a probability threshold value of 20/52,
the seven of diamonds is designated a probability threshold value of 21/52,
the seven of hearts is designated a probability threshold value of 22/52,
the seven of clubs is designated a probability threshold value of 23/52,
the seven of spades is designated a probability threshold value of 24/52,
the eight of diamonds is designated a probability threshold value of 25/52,
the eight of hearts is designated a probability threshold value of 26/52,
the eight of clubs is designated a probability threshold value of 27/52,
the eight of spades is designated a probability threshold value of 28/52,
the nine of diamonds is designated a probability threshold value of 29/52,
the nine of hearts is designated a probability threshold value of 30/52,
the nine of clubs is designated a probability threshold value of 31/52,
the nine of spades is designated a probability threshold value of 32/52,
the ten of diamonds is designated a probability threshold value of 33/52,
the ten of hearts is designated a probability threshold value of 34/52,
the ten of clubs is designated a probability threshold value of 35/52,
the ten of spades is designated a probability threshold value of 36/52,
the jack of diamonds is designated a probability threshold value of 37/52,
the jack of hearts is designated a probability threshold value of 38/52,
the jack of clubs is designated a probability threshold value of 39/52,
the jack of spades is designated a probability threshold value of 40/52,
the queen of diamonds is designated a probability threshold value of 41/52,
the queen of hearts is designated a probability threshold value of 42/52,
the queen of clubs is designated a probability threshold value of 43/52,
the queen of spades is designated a probability threshold value of 44/52,
the king of diamonds is designated a probability threshold value of 45/52
the king of hearts is designated a probability threshold value of 46/52,
the king of clubs is designated a probability threshold value of 47/52,
the king of spades is designated a probability threshold value of 48/52,
the ace of diamonds is designated a probability threshold value of 49/52,
the ace of hearts is designated a probability threshold value of 50/52,
the ace of clubs is designated a probability threshold value of 5/52, and
the ace of spades is designated a probability threshold value of 52/52;

allotting each card in the standard fifty two playing card deck a unique hierarchy value, wherein the two of diamonds is allotted a card hierarchy value of 1,
the two of hearts is allotted a card hierarchy value of 2,
the two of clubs is allotted a card hierarchy value of 3,
the two of spades is allotted a card hierarchy value of 4,
the three of diamonds is allotted a card hierarchy value of 5;
the three of hearts is allotted a card hierarchy value of 6,
the three of clubs is allotted a card hierarchy value of 7,
the three of spades is allotted a card hierarchy value of 8,
the four of diamonds is allotted a card hierarchy value of 9,
the four of hearts is allotted a card hierarchy value of 10,
the four of clubs is allotted a card hierarchy value of 11,
the four of spades is allotted a card hierarchy value of 12,
the five of diamonds is allotted a card hierarchy value of 13,
the five of hearts is allotted a card hierarchy value of 14,
the five of clubs is allotted a card hierarchy value of 15,
the five of spades is allotted a card hierarchy value of 16,
the six of diamonds is allotted a card hierarchy value of 17,
the six of hearts is allotted a card hierarchy value of 18,
the six of clubs is allotted a card hierarchy value of 19,
the six of spades is allotted a card hierarchy value of 20,
the seven of diamonds is allotted a card hierarchy value of 21,
the seven of hearts is allotted a card hierarchy value of 22,
the seven of clubs is allotted a card hierarchy value of 23,
the seven of spades is allotted a card hierarchy value of 24,
the eight of diamonds is allotted a card hierarchy value of 25,
the eight of hearts is allotted a card hierarchy value of 26, the eight of clubs is allotted a card hierarchy value of 27, the eight of spades is allotted a card hierarchy value of 28, the nine of diamonds is allotted a card hierarchy value of 29, the nine of hearts is allotted a card hierarchy value of 30, the nine of clubs is allotted a card hierarchy value of 31, the nine of spades is allotted a card hierarchy value of 32, the ten of diamonds is allotted a card hierarchy value of 33, the ten of hearts is allotted a card hierarchy value of 34, the ten of clubs is allotted a card hierarchy value of 35, the ten of spades is allotted a card hierarchy value of 36, the jack of diamonds is allotted a card hierarchy value of 37, the jack of hearts is allotted a card hierarchy value of 38, the jack of clubs is allotted a card hierarchy value of 39, the jack of spades is allotted a card hierarchy value of 40, the queen of diamonds is allotted a card hierarchy value of 41, the queen of hearts is allotted a card hierarchy value of 42, the queen of clubs is allotted a card hierarchy value of 43, the queen of spades is allotted a card hierarchy value of 44, the queen of diamonds is allotted a card hierarchy value of 45, the king of hearts is allotted a card hierarchy value of 46, the king of hearts is allotted a card hierarchy value of 47, the king of spades is allotted a card hierarchy value of 48, the ace of diamonds is allotted a card hierarchy value of 49, the ace of hearts is allotted a card hierarchy value of 50, the ace of clubs is allotted a card hierarchy value of 51, and the ace of spades is allotted a card hierarchy value of 52, calculating a win-tie index for each particular team, wherein the win-tie index for each particular team is calculated by adding the total number of ties the corresponding ice hockey team achieved in the previous season to two times the total number of wins the corresponding ice hockey team achieved in the previous season;

designating one of the opposing teams as a home team and the other opposing team as a visitor team;

calculating a power index for each particular team, wherein the power index for each particular team is the win-tie index for each particular team plus ten points if the particular team is designated as the home team and minus ten points if the particular team is designated as the visitor team;

calculating a relative power factor, wherein the relative power factor is calculated by taking the absolute value of the difference in the power indexes of each team and dividing this absolute value by twenty five, and then rounding the quotient to the nearest one-quarter point;

calculating a goalie strength index for each particular team, wherein the goalie strength index for each particular team is calculated by dividing the total number of saves achieved by the corresponding ice hockey team in the previous season by the total number of shots attempted against the goal of the corresponding ice hockey team in the previous season;

calculating a goalie susceptibility index for each particular team, wherein the goalie susceptibility index for each particular team is calculated by subtracting the corresponding goalie strength index of each particular team from one;

assigning a goalie card for each particular team, wherein the goalie card for each particular team is assigned to the playing card having a probability threshold value closest to the goalie susceptibility index for the respective team;

assigning a defensive threshold value for each particular team to be the point value associated with the goalie card for the respective team;

calculating an offensive strength index for each particular team by subtracting the average number of shots per game that the corresponding ice hockey team attempted in the previous season from an offensive weight factor, wherein said offensive weight factor is assigned a valued of sixty two;

identifying an offensive strength threshold card for each particular team to be the card that is associated with the card hierarchy value that most closely matches the offensive strength index for each particular team;

assigning an offensive strength threshold card value for each particular team to be the point value corresponding to the offensive strength threshold card for each particular team;

assigning a power play control factor, wherein the power play control factor is assigned a value of 4 points;

assigning a power play shot factor, wherein the power play shot factor is assigned a value of 2 points;

assigning a power play goal factor, wherein the power play goal factor is assigned a value of ½ point;

assigning a short-handed shot factor, wherein the short-handed shot factor is assigned a value of 2 points;

assigning a short-handed goal factor, wherein the short-handed goal factor is assigned a value of ¾ point;

assigning a two-man power play control factor, wherein the two-man power play control factor is assigned a value of 5 points;

assigning a two-man power play shot factor, wherein the two-man power play shot factor is assigned a value of 2 points;

assigning a two-man power play goal factor, wherein the two-man power play goal factor is assigned a value of ¾ point;

assigning an offensive open-net control factor, wherein the open-net control factor is assigned a value of 5 points;

assigning an offensive open-net shot factor, wherein the open-net shot factor is assigned a value of 2 points;

assigning an offensive open-net goal factor, wherein the open-net goal factor is assigned a value of ¾ point;

assigning a defensive open-net shot factor, wherein the defensive-open net shot factor is assigned a value of 2 points;

assigning a defensive open-net goal factor, wherein the defensive-open net goal factor is assigned a value of 7 points;

assigning a breakaway control factor, wherein the breakaway control factor is assigned a value of 5 points;

assigning a breakaway shot factor, wherein the breakaway shot factor is assigned a value of 4 points;

assigning a breakaway goal factor, wherein the breakaway goal factor is assigned a value of at least 3 points;

assigning an ace goal factor; wherein the ace goal factor is assigned a value of ¼ point;

assigning at least one penalty card, wherein the penalty card is assigned to be at least the two of diamonds;

assigning a penalty shot card to be at least the ace of diamonds;

assigning a time segment associated with each play, wherein the time segment is assigned to represent 6 seconds of play time in the ice hockey match;

combining three standard fifty two playing card decks randomly together to form a combined deck;

assembling a play deck comprising one hundred and six playing cards from the combined deck;

making a miscellaneous deck comprising fifty playing cards from the combined deck;

declaring if any one of the opposing teams will play a round in an open net offense mode of play, wherein said declaring is declared by the team that intends to play the round as an open net offense mode of play;

drawing one card from the play deck for each of the two opposing teams;

pulling one card from the miscellaneous deck when the drawn card is the penalty card, wherein said pulling is performed by the team that drew the penalty card from the play deck;

receiving a major penalty when the pulled card from the miscellaneous deck is also the penalty card, wherein the major penalty is received by the team that drew the penalty card from the play deck and pulled the penalty card from the miscellaneous deck, wherein the major penalty enables the non-penalized team to use the power play mode of play for 50 turns in the hockey sports game when the penalized team is subjected to one penalty, and wherein the major penalty enables the non-penalized team to use the two man power play mode of play for up to 49 turns in the hockey card game when the penalized team is subjected to two or more penalties, whereby the major penalty represents an ice hockey player being placed on the bench for five minutes during an ice hockey match;

obtaining a minor penalty when the pulled card from the miscellaneous deck is not the penalty card, wherein the minor penalty is obtained by the team that drew the penalty card from the play deck and pulled the card from the miscellaneous deck which was not the penalty card, wherein the minor penalty enables the non-penalized team to use the power play mode of play for up to 20 turns in the hockey sports game when the penalized team is subject to one penalty, wherein the minor penalty enables the non-penalized team to use the double man power play mode of play for up to 19 turns in the hockey sports game when the penalized team is subjected to two or more penalties, and wherein the minor penalty is lifted against the penalized team in the event that the non-penalized team scores a goal within the 20 turns associated with the penalized team obtaining the minor penalty, whereby the minor penalty represents the situation in the ice hockey match when the ice hockey player is taken out of the ice hockey match and placed on the bench for up to two minutes during the ice hockey match or until the non-penalized ice hockey team scores an goal;

getting a penalty shot possibility imposed against the penalized team when the pulled card from the miscellaneous deck is the penalty shot card, wherein the team that gets the penalty shot possibility imposed against it is the team that drew penalty card from the play deck and pulled the penalty shot card from the miscellaneous deck;

taking one card from the miscellaneous deck by the non-penalized team after the penalty shot possibility is imposed against the penalized team to determine when the non-penalized team is able to control the puck, wherein the non-penalized team is the team that did not draw the penalty card from the play deck nor pulled the penalty shot card from the miscellaneous deck;

calculating a penalty shot threshold criteria for the non-penalized team by subtracting the breakaway shot factor from the offensive strength threshold value associated with the non-penalized team;

making a penalty shot when the point value of the card taken from the miscellaneous deck by the non-penalized team is greater than or equal to the point value of the penalty shot threshold criteria for the non-penalized team;

selecting one card from the miscellaneous deck by the penalized team when the penalty shot is made by the non-penalized team, wherein the penalized team is the team that drew the penalty card from the play deck and got the penalty shot card from the miscellaneous deck;

calculating a goalie block shot threshold criteria for the penalized team by adding the breakaway goal factor to the defensive threshold value associated with the penalized team;

scoring a goal from a penalty shot when the value of the card selected from the miscellaneous deck is less than the goalie block shot threshold criteria for the penalized team;

picking one card from the miscellaneous deck for each opposing team when any card drawn from the play deck is an ace;

summing the point value of the corresponding drawn card to the point value of the corresponding picked card for each opposing team;

finding the difference in the point value sums of the drawn card and the picked card between the opposing teams;

enabling the team that drew the ace from the play deck to be in a breakaway mode of play when the difference in the point value sums of the drawn card and the picked card between the opposing teams is found to be greater than or equal to fourteen;

accruing a card from the play deck for each for the opposing teams when both teams are found to have drawn cards that have point values greater than their respective control threshold values;

unenabling the breakaway mode of play when both teams are found to have drawn cards that have point values greater than their respective control threshold values;

choosing a card from the miscellaneous deck for each opposing team when any card accrued from the play deck is an ace;

summing the point value of the corresponding accrued card to the point value of the corresponding chosen card for each opposing team;

finding the difference in the point value sums of the accrued card and the chosen card between the opposing teams, enabling the team that accrued the ace from the play deck to be in a breakaway mode of play when the difference in the point value sums of the accrued card and the chosen card is found to be greater than or equal to fourteen;

retrieving a card from the play deck for each for the opposing teams when both teams are found to have both drawn cards that have point values less than their respective control threshold values;

unenabling the breakaway mode of play when both teams are found to have drawn cards that have point values greater than their respective control threshold values;

obtaining a card from the miscellaneous deck from each opposing team when any card accrued from the play deck is an ace;

summing the point value of the corresponding retrieved card to the point value of the obtained corresponding obtained card for each opposing team;

finding the difference in the point value sums of the retrieved card and the obtained card between the opposing teams;

enabling the team that retrieved the ace from the play deck to be in a breakaway mode of play when the difference in the point value sums of the retrieved card and the obtained card is found to be greater than or equal to fourteen;

calculating a control factor sum for each opposing team, wherein the relative power factor is added to the control factor sum of the particular team when the particular team has been determined to be the team associated with having the larger of the two power indexes between the two opposing teams, wherein the power play control factor is added to the control factor sum of the particular team when the team opposing the particular team is subject to only the minor penalty, wherein the two-man power play control factor is added to the control factor sum of the particular team when the team opposing the particular team is subject to the major penalty, wherein the open net control factor is added to the control factor sum of the particular team when the particular team declared prior to drawing the card from the play deck that it intended to play an open-net offense, and wherein the breakaway control factor is added to the control factor sum of the particular team when the particular team is enabled in the breakaway mode of play;

determining which team is associated with the larger of the two control factor sums;

finding the absolute value of the difference in the control factor sums between the two opposing teams;

calculating a control threshold value for each opposing team, wherein the control threshold value for the particular team that is determined to be the team associated with the larger of the two control factor sums is the absolute value of the difference in the control factor sums between the two opposing teams, and wherein the control threshold value for the particular team that was not determined to be the team associated with the larger of the two control factor sums is zero;

gleaning a card from the play deck by a particular team when the card drawn by the particular team is found to have a point value greater than the control threshold value associated with the particular team and when the opposing team is found to have drawn a card from the play deck that has a point value less than the control threshold value associated with the opposing team, whereby said gleaning represents winning offensive control of the puck in the ice hockey match followed by an attempted offensive shot at the goal;

gleaning a card from the play deck by a particular team when the card accrued by the particular team is found to have a point value greater than the control threshold value associated with the particular team and when the opposing team is found to have accrued a card from the play deck that has a point value less than the control threshold value associated with the opposing team, whereby said gleaning represents winning offensive control of the puck in the ice hockey match followed by an attempted offensive shot at the goal;

gleaning a card from the play deck by a particular team when the card retrieved by the particular team is found to have a point value greater than the control threshold value associated with the particular team and when the opposing team is found to have retrieved a card from the play deck that has a point value less than the control threshold value associated with the opposing team, whereby said gleaning represents winning offensive control of the puck in the ice hockey match followed by an attempted offensive shot at the goal;

calculating a shot factor sum for the particular team that gleaned the card from the play deck, wherein the power play shot factor is added to the shot factor sum when the team opposing the particular team is subject to the minor penalty, wherein the short handed shot factor is added to the shot factor sum when the particular team is the penalized team;

wherein the two-man power play control factor is added to the shot factor sum when the team opposing the particular team is subject to the major penalty, wherein the open net shot factor is added to the shot factor sum when the team opposing the particular team declared prior to drawing the card from the play deck that it intended to play an open-net offense, and wherein the defensive open net shot factor is added to the shot factor sum when the team that did not glean the card from the play deck is also the team that declared that it would play a round in the open net offense mode of play, and wherein the breakaway shot factor is added to the shot factor sum when the particular team is enabled to be in the breakaway mode of play;

calculating a shot threshold value for the particular team that gleaned the card from the play deck, wherein the shot threshold value for the particular team is the offensive strength index for the particular team minus the shot factor sum for the particular team;

wherein when a gleaned card is found to have a point value greater than or equal to the shot threshold value, the gleaned card represents a shot taken by the particular team at the opposing teams goal;

collecting a card from the play deck by the particular team when the gleaned card is found to have a point value equal to or between one quarter and two points less then the shot threshold value corresponding to the particular team, wherein when the gleaned card is found to have a point value equal to or between one quarter and two point less then the shot threshold value corresponding to the particular team then the gleaned represents a first puck pass made by the particular team, wherein when the collected card from the playing is found to have a point value equal to or greater than to the shot threshold value corresponding to the particular team then the collected card represents a shot taken by the particular team at the opposing teams goal;

drawing another card from the play deck for each of the two opposing teams when said collecting results in a card that is found to have a point value less than two points below lower then the shot threshold value corresponding to the particular team that collected the collected card;

extracting a card from the play deck by the particular team when the collected card is found to have a point value equal to or between one quarter and two points less than the shot threshold value corresponding to the particular team and when the collected card is found to have a point value less than the point value of the gleaned card, wherein when the collected card is found to have a point value equal to or between one quarter and two points less than the shot threshold value corresponding to the particular team and when the collected card is found to have a point value less than the point value of the gleaned card then the collected card represents a second puck pass made by the particular team;

wherein when the extracted card from the playing is found to have a point value greater than or equal to the shot threshold value corresponding to the particular team then the extracted card represents a shot by the particular team at the opposing teams goal;

drawing another card from the play deck for each of the two opposing teams when said extracting results in a card that is found to have a point value less than two points lower the shot threshold value corresponding to the particular team that extracted the extracted card;

garnishing a card from the play deck by the particular team when the extracted card is found to have a point value equal to or between one quarter and two points less than the shot threshold value corresponding to the particular team and when the extracted card is found to have a point value less than the point value of the collected card, wherein when the extracted card is found to have a point value equal to or between one quarter and two points less than the shot threshold value corresponding to the particular team and when the extracted card is found to have a point value less than the point value of the collected card then the extracted card represents a third puck pass made by the particular team;

wherein when the garnished card from the playing is found to have a point value greater than or equal to the shot threshold value corresponding to the particular team then the garnished card represents a shot by the particular team at the opposing teams goal;

drawing another card from the play deck for each of the two opposing teams when said garnishing results in a card that is found to have a point value less than two points lower the shot threshold value corresponding to the particular team that garnished the garnished card;

securing a card from the play deck by the particular team when the garnished card is found to have a point value equal to or between one quarter and two points less than the shot threshold value corresponding to the particular team and when the garnished card is found to have a point value less than the point value of the extracted card, wherein when the garnished card is found to have a point value equal to or between one quarter and two points less than the shot threshold value corresponding to the particular team and when the garnished card is found to have a point value less than the point value of the extracted card then the garnished card represents a fourth puck pass made by the particular team;

wherein when the secured card from the playing is found to have a point value greater than or equal to the shot threshold value corresponding to the particular team then the secured card represents a shot by the particular team at the opposing teams goal;

drawing another card from the play deck for each of the two opposing teams when said securing results in a card that is found to have a point value less than two points lower the shot threshold value corresponding to the particular team that secured the secured card;

grabbing a card from the play deck by the particular team when the secured card is found to have a point value equal to or between one quarter and two points less than the shot threshold value corresponding to the particular team and when the secured card is found to have a point value less than the point value of the garnished card, wherein when the secured card is found to have a point value equal to or between one quarter and two points less than the shot threshold value corresponding to the particular team and when the secured card is found to have a point value less than the point value of the garnished card then the secured card represents a fifth puck pass made by the particular team;

wherein when the grabbed card from the playing is found to have a point value greater than or equal to the shot threshold value corresponding to the particular team then the grabbed card represents a shot by the particular team at the opposing teams goal;

drawing another card from the play deck for each of the two opposing teams when said grabbing results in a card that is found to have a point value less than two points lower the shot threshold value corresponding to the particular team that grabbed the grabbed card;

compiling a card from the play deck by the particular team when the grabbed card is found to have a point value equal to or between one quarter and two points less than the shot threshold value corresponding to the particular team and when the grabbed card is found to have a point value less than the point value of the secured card, wherein when the grabbed card is found to have a point value equal to or between one quarter and two points less than the shot threshold value corresponding to the particular team and when the grabbed card is found to have a point value less than the point value of the secured card then the grabbed card represents a sixth puck pass made by the particular team;

wherein when the compiled card from the playing is found to have a point value greater than or equal to the shot threshold value corresponding to the particular team then the compiled card represents a shot by the particular team at the opposing teams goal;

drawing another card from the play deck for each of the two opposing teams when said compiling results in a card that is found to have a point value less than two points lower the shot threshold value corresponding to the particular team that compiled the compiled card;

culling a card from the play deck by the particular team when the compiled card is found to have a point value equal to or between one quarter and two points less than the shot threshold value corresponding to the particular team and when the compiled card is found to have a point value less than the point value of the grabbed card, wherein when the compiled card is found to have a point value equal to or between one quarter and two points less than the shot threshold value corresponding to the particular team and when the compiled card is found to have a point value less than the point value of the grabbed card then the compiled card represents a seventh puck pass made by the particular team;

wherein when the culled card from the playing is found to have a point value greater than or equal to the shot threshold value corresponding to the particular team then the culled card represents a shot by the particular team at the opposing teams goal;

drawing another card from the play deck for each of the two opposing teams when said culling results in a card that is found to have a point value less than two points lower the shot threshold value corresponding to the particular team that culled the culled card;

gathering a card from the play deck by the particular team when the culled card is found to have a point value equal to or between one quarter and two points less than the shot threshold value corresponding to the particular team and when the culled card is found to have a point value less than the point value of the compiled card, wherein when the culled card is found to have a point value equal to or between one quarter and two points less than the shot threshold value corresponding to the particular team and when the culled card is found to have a point value less than the point value of the compiled card then the culled card represents a eighth puck pass made by the particular team;

wherein when the gathered card from the playing is found to have a point value greater than or equal to the shot threshold value corresponding to the particular team then the gathered card represents a shot by the particular team at the opposing teams goal;

drawing another card from the play deck for each of the two opposing teams when said gathering results in a card that is found to have a point value less than two points lower the shot threshold value corresponding to the particular team that gathered the gathered card;

acquiring a card from the play deck by the team that did not glean the card that had a point value greater than or equal to the shot threshold value corresponding to the particular team, wherein said acquiring the card from the play deck is acquired after the particular team gleaned a card that had a point value greater than or equal to the shot threshold value corresponding to the particular team, wherein the team that did not glean the card that had a point value greater than or equal to the shot threshold value corresponding to the particular team is designated as the defending team;

wherein the particular team that gleaned the card that had a point value greater than or equal to the shot threshold value corresponding to the particular team is designated as the offensive team, wherein said acquiring by the defending team represents an offensive shot followed by a defensive stance by the goalie in the ice hockey match;

calculating a goal factor sum for the defending team, wherein the power play goal factor is added to the goal factor sum when the defending team subject to only the minor penalty, wherein the short-handed goal factor is subtracted to the goal factor sum when the offensive team that gleaned the card is subject to the minor penalty or the major penalty, wherein the two-man power play goal factor is added to the goal factor sum when the defending team is subject to the major penalty, wherein the offensive open-net goal factor is added to the goal factor sum when the defending team declared prior to drawing the card from the play deck that it intended to play an open-net offense, wherein the defensive open-net goal factor is subtracted to the goal factor sum when the defending team declared prior to drawing the card from the play deck that it intended to play an open-net offense, wherein the breakaway goal factor is added to the goal factor sum when the offensive team is enabled to be in the breakaway mode of play, and wherein the ace goal factor is added to the goal factor sum when the offensive team gleaned an ace when gleaning the card in the play deck;

calculating a defensive block shot threshold criteria by adding the point value associated with the goalie card for the respective defending team to the goal factor sum;

scoring a goal by the offensive team when the acquired card from the play deck by the defending team is found to have a point value less than the defensive block shot threshold criteria associated with the defending team;

drawing a card from the play deck for each of the two opposing teams when said acquiring the acquired card from the play deck by the defending team is found not to have a point value less than the defensive block shot threshold criteria associated with the defending team; and using up all of the cards in the play deck, wherein said using represents the entire play during a quarter of the ice hockey match.

* * * * *